US008714541B2

(12) United States Patent
Kato

(10) Patent No.: US 8,714,541 B2
(45) Date of Patent: May 6, 2014

(54) IMAGE RECORDING APPARATUS AND CONTROL METHOD THEREOF

(75) Inventor: Takahiro Kato, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 206 days.

(21) Appl. No.: 13/219,937

(22) Filed: Aug. 29, 2011

(65) Prior Publication Data

US 2012/0056365 A1 Mar. 8, 2012

(30) Foreign Application Priority Data

Sep. 6, 2010 (JP) ..... 2010-198997

(51) Int. Cl.
*B65H 3/44* (2006.01)

(52) U.S. Cl.
USPC ..... 271/9.1; 226/10

(58) Field of Classification Search
USPC ..... 271/9.1; 226/4, 10, 11, 24, 45, 108
See application file for complete search history.

(56) References Cited

U.S. PATENT DOCUMENTS 5,241,884 A * 9/1993 Smithe et al. ..... 83/76
2012/0056927 A1* 3/2012 Mitsuhashi et al. ..... 347/16

FOREIGN PATENT DOCUMENTS

JP 8-324052 A 12/1996
JP 2001-97582 A 4/2001
JP 2002-234222 A 8/2002
JP 2002234222 A * 8/2002

* cited by examiner

*Primary Examiner* — Jeremy R Severson
(74) *Attorney, Agent, or Firm* — Canon USA, Inc., IP Division

(57) ABSTRACT

An image recording apparatus, for conveying a roll paper as a sheet and a cut paper as a sheet to record an image on the sheet, includes a sheet type selecting unit, a rotation amount measurement unit, a determination unit, a conveyance suspension unit, and a first conveyance restarting unit. The sheet type selecting unit allows a user to select a roll paper mode and a cut paper mode. The determination unit determines whether a conveyed sheet is the roll paper or the cut paper based on the rotation amount measured by the rotation amount measurement unit. The conveyance suspension unit suspends the sheet conveyance in response to it being determined that the conveyed sheet is different from the selected sheet type. The first conveyance restarting unit restarts a sheet conveyance by the conveyance suspended during the cut paper mode, by switching to the roll paper mode.

31 Claims, 15 Drawing Sheets

IMAGE RECORDING APPARATUS AND CONTROL METHOD THEREOF

BACKGROUND OF THE INVENTION

1. Field of the Invention

The present invention relates to an image recording apparatus and a control method thereof. More specifically, the present invention relates to the image recording apparatus wherein a recording head and a recording material are relatively moved to perform recording and the control method thereof. Still more specifically, the present invention relates to the control method that a roll paper and a cut paper are inserted through a common paper feed port and conveyed.

2. Description of the Related Art

Generally, an ink jet recording apparatus performs recording such that an ink is discharged from a recording head onto a recording material. Downsizing of the recording head can be achieved with ease, a high-resolution image can be recorded at high speed, an inexpensive running cost can be achieved, and a noise can be reduced because of a non-impact system. Further, the ink jet recording apparatus has an advantage that a color image can be recorded with ease by using multiple color inks.

Generally, the inkjet recording apparatus can record an image onto various types of recording materials such as a sheet. More specifically, the ink jet recording apparatus can use various types of sheets such as a calendered paper and a coated paper, various sizes of sheets such as A4 typical size and A0 typical size, and a plurality of types of sheets such as a cut paper and a roll paper. By using the above features, a print product to be used in various fields such as a point-of-purchase advertisement (POP) and a poster can be produced in addition to general printed matters such as a document and a photograph.

FIG. 7 of Japanese Patent Laid-open Publication No. 08-324052 discusses a known image recording apparatus having a configuration that a cut paper and a roll paper wound around a spool can be inserted through a common paper feed port. In the image recording apparatus having the above descried configuration, prior to a supply of the sheet to the image recording apparatus, information as to which sheet of the roll paper or the cut paper is to be conveyed is input via some sort of selecting unit into the image recording apparatus. As described above, a type of sheet is preliminarily notified to the image recording apparatus, so that an optimum control can be performed according to the types of sheets with respect to various operations including paper feeding, image recording (e.g., printing), and paper discharging. Japanese Patent Laid-open Publication No. 2002-234222 discusses an image recording apparatus having a configuration that any one of a plurality of buttons provided on an operation panel of the image recording apparatus is pressed in order to select the type of sheet. Japanese Patent Laid-open Publication No. 2001-97582 discusses an image recording apparatus having a configuration in which the selection of the type of sheet is carried out according to a length of time for pressing a single button.

An image recording apparatus having a configuration that the roll paper and the cut paper are discharged from a common conveyance path is also known. The desirable image recording apparatus having the above configuration specifies the type of sheet to be discharged, by the above described means for selecting the type of sheet and performs the optimum control in discharging the sheet. Japanese Patent Laid-open Publication No. 2001-97582 discusses an image recording apparatus that discriminates the type of sheet according to whether a trailing edge of the sheet is detected at a predetermined position within a predetermined conveyance amount when the sheet is conveyed to a downstream portion for the sake of discharging the sheet after recorded.

Japanese Utility Model Application Laid-open Publication No. 07-31391 discusses an image recording apparatus that determines the type of sheet, i.e., whether the sheet inserted into the paper feed port (i.e., an entrance section of the conveyance path of the sheet) is the roll paper or the cut paper when it is conveyed to a section for forming an image (i.e., an image forming unit) within the apparatus. In the image recording apparatus discussed in Japanese Utility Model Application Laid-open Publication No. 07-31391, presence or absence of a rotation of a spool holding the roll paper enables a determination of the type of sheet and a result of the determination is used in deciding whether it is necessary or unnecessary to cut the sheet after an image recording operation.

As described above, the image recording apparatus controls a conveyance of sheet according to the type of sheet selected by a user. Therefore, in a case where the selected type of sheet matches the type of sheet actually fed and conveyed, a normal and optimum conveyance of the sheet is performed. However, in a case where the type of sheet disagrees with the type of sheet actually fed and conveyed, many problems occur.

For example, the following problem may occur at a time of feeding a sheet (at a time of conveyance of a sheet after a start of conveyance of the sheet and immediately before the recording of the sheet). A case is considered where a cut paper is inserted into a paper feed port when the roll paper is selected as the type of sheet (hereinafter referred to as the "roll paper mode"). In this case, when the cut paper is fed, the cut paper is pinched by a line feed roller (hereinafter referred to as the "LF roller") pair, made of a line feed roller and a pinch roller, which are placed at an upstream side of the image forming unit, and largely conveyed in a downstream direction. Since the sheet has an enough length in a case of the roll paper, a skew correction and a skew detection of the roll paper can be performed by the above processing. However, since the cut paper has less sheet length, the sheet may be discharged to an outside of the apparatus or an error indicating a run-out of paper is erroneously detected, causing a suspension of an operation of the apparatus. Further, a case is considered where the roll paper is inserted into the paper feed port when the cut paper is selected as the type of sheet (hereinafter referred to as the "cut paper mode"). In this case, a leading edge of the roll paper is brought into contact with the LF roller pair to form a predetermined loop in the upstream side of the roller pair. Then, the roll paper is pinched by the LF roller pair to be conveyed to the downstream image forming unit. In a case of the cut paper, since the leading edge of the sheet is straightly aligned, a skew correction and a positioning can be performed in the above described manner. However, since the leading edge of the roll paper is not sometimes straightly aligned, if the roller paper is fed in the same manner as it is done for the cut paper, the roller paper may be skewed for this sake or a paper jam may occur.

At the time of discharging the sheet (i.e., when the sheet is conveyed to be discharged outside the apparatus after an image is recorded thereon), the following problem may occur. In the roll paper mode, the sheet is cut by a cutter at an upstream portion of the sheet where the image is formed, thereby cutting out the sheet from a rolling portion of the roll paper. In a case of the roll paper, no problem occurs since the sheet has the enough length. However, in a case where the sheet is the cut paper, since the sheet has a shorter length, an error indicating a run-out of the cut paper is detected while the cut paper is conveyed, thereby suspending a conveyance operation. If the roll paper is discharged when the apparatus is in the cut paper mode, the apparatus tries to convey the sheet to the downstream side (i.e., in a paper discharge direction) until a trailing edge of the sheet is detected. In a case where the sheet is the cut paper, since the sheet has a shorter length, the trailing edge of the sheet is immediately detected and the conveyance of the sheet is suspended, resulting in normal discharge of the sheet. However, since the roll paper has longer sheet length, the trailing edge of the sheet is not detected however much the sheet is conveyed and thus a large amount of roll paper is wound off. When the trailing edge of the sheet is not detected before a predetermined conveyance amount is conveyed, a countermeasure, e.g., suspension of the conveyance of the sheet, may be taken. However, if a normal discharge of the cut paper of a larger size such as A0 typical size (i.e., 841×1189 mm) is considered, the predetermined conveyance amount cannot be set to a small value and thus the roll paper may be wound off uneconomically.

SUMMARY OF THE INVENTION

The present invention is directed to an image recording apparatus capable of solving at least one of the above described problems that occur in a case where a type of a sheet selected by a user differs from an actual type of sheet and a control method thereof.

According to an aspect of the present invention, an image recording apparatus for conveying a roll paper and a cut paper as a sheet on a common conveyance path to record an image on the sheet includes a sheet type selecting unit configured to allow a user to select either one of a roll paper mode for conveying the roll paper and a cut paper mode for conveying the cut paper, a rotation amount measurement unit configured to measure a rotation amount of a rolling portion of the roll paper, a determination unit configured to determine whether the sheet is the roll paper or the cut paper based on the rotation amount measured by the rotation amount measurement unit during a conveyance of the sheet, a conveyance suspension unit configured to suspend the conveyance of the sheet when the determination unit determines that the sheet different from the sheet type selected by the sheet type selecting unit is conveyed, and a first conveyance resumption unit configured to restart the sheet conveyance suspended by the conveyance suspension unit during the cut paper mode, by switching the mode to the roll paper mode.

According to another aspect of the present invention, a control method of an image recording apparatus for conveying a roll paper and a cut paper as a sheet on a common conveyance path and performing recording onto the sheet includes allowing a user to select a sheet type from either one of a roll paper mode for conveying the roll paper and a cut paper mode for conveying the cut paper, measuring a rotation amount of a rolling portion of the roll paper while the sheet is conveyed, determining whether the sheet is the roll paper or the cut paper based on the measured rotation amount, suspending the conveyance of the sheet when a determination is made that a sheet incompatible with a mode selected in the sheet type selection is conveyed, and first conveyance resuming in which the conveyance of the sheet suspended during the cut paper mode is restarted by switching the mode to the roll paper mode.

According to yet another aspect of the present invention, a program causes a computer to execute the control method of the image recording apparatus and a computer readable storage medium stores the program.

According to the present invention, when a determination is made that a sheet incompatible with a selected sheet type is conveyed, a conveyance of the sheet is suspended, so that a skew of the sheet or a paper jam which occurs because of a conveyance of the sheet in an erroneous conveyance mode can be prevented or winding-off of the roll paper by a large amount can be avoided. According to an aspect of the present invention, even in a case where a sheet of the erroneous type is set, the conveyance can be restarted without offsetting the sheet again or causing damage on the sheet by restarting the conveyance after switching a mode to the normal conveyance mode.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

In the following exemplary embodiment, an ink jet printer is an example of an image recording apparatus. However, the present invention is not limited to the ink jet printer. The present invention is applicable to a general image recording apparatus having such a conveyance mechanism that a roll paper and a cut paper are inserted through a common paper feed port to convey the sheet.

Figure 1:
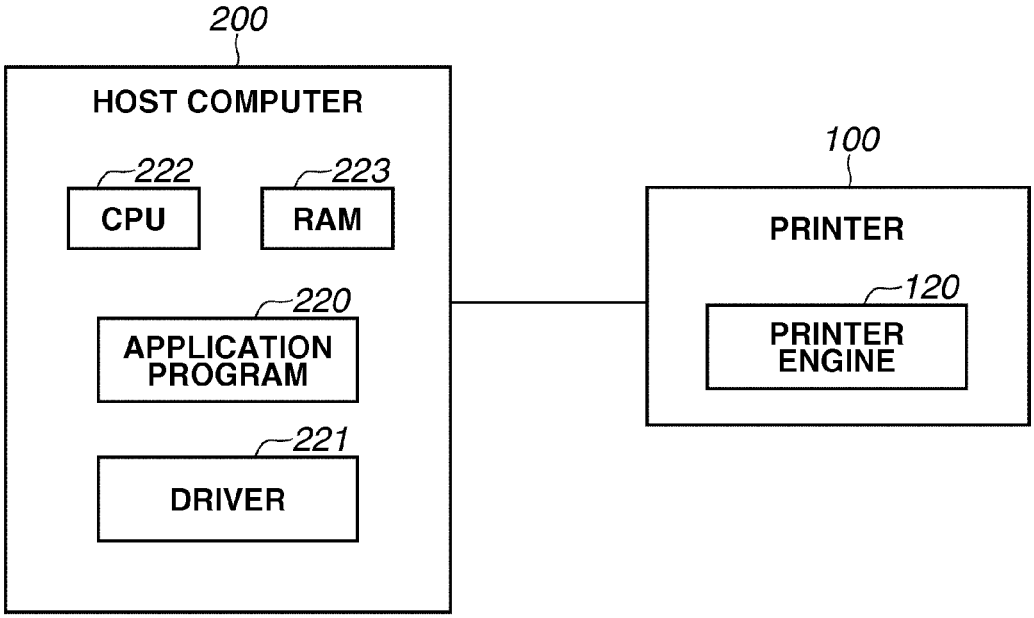
FIG. 1 is a block diagram illustrating a schematic configuration of an image recording system.

FIG. 1 is a block diagram illustrating a schematic configuration of an image recording system according to a first exemplary embodiment of the present invention. In FIG. 1, an image recording apparatus (e.g., an ink jet printer) 100 according to the exemplary embodiment of the present invention includes, for example, a printer engine 120 for recording an image by an ink jet method. The printer engine 120 is a color recording printer engine. The image recording apparatus 100 includes a plurality of recording heads (i.e., ink jet recording heads) for discharging inks corresponding to colors of Y, M, C, and K. In the image recording apparatus 100, the plurality of recording heads are scanned reciprocally in a main scanning direction to record am image onto a sheet as a recording material. A configuration of the image recording apparatus 100 is described below in detail with reference to FIGS. 4 and 5.

A host computer 200 stores various application programs 220, a printer driver 221 for the ink jet printer 100, and the like in a hard disk (not illustrated). A control method of the image recording apparatus of the present invention may be executed by the image recording apparatus 100 itself or may be executed by the printer driver 221 of the host computer 200. The printer driver 221, stored in a storage medium such as a compact disk read only memory (CD-ROM), is provided from a maker of the printer 100 to be installed into the hard disk of the host computer 200. Subsequently, the printer driver 221 is loaded to a Random Access Memory (RAM) 223 of the host computer 200 at a time of execution of the printer driver 221 under a control of a central processing unit (CPU) 222.

The image recording apparatus 100 receives recoding data transmitted from the printer driver 221 and records the image by a recording method thus instructed, e.g., a multi-pass recording method. The image recording apparatus 100 contains mask information for specifying a dot position for recording in each scanning and specifies the dot position (e.g., a nozzle) for recording in each pass according to the mask information. However, the mask information may be contained in the host computer 200 and the image recording apparatus 100 may perform recording only based on the received recording data.

Figure 2:
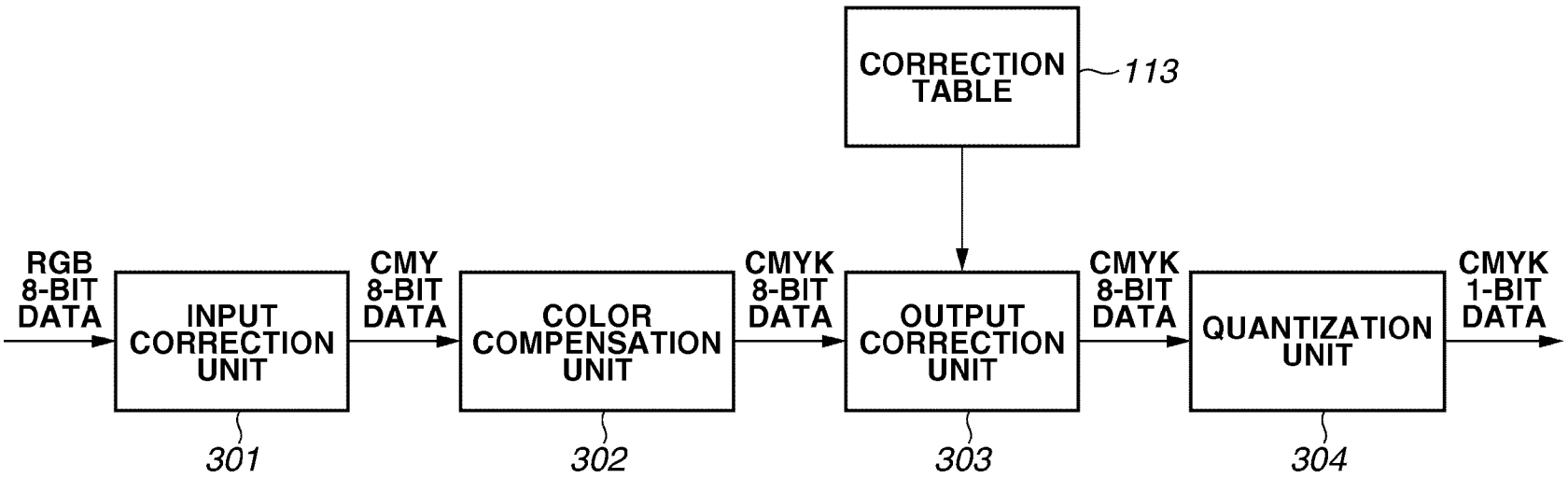
FIG. 2 is a block diagram illustrating a configuration for explaining processing of image information in a printer driver.

FIG. 2 is a block diagram illustrating a configuration for processing of image information in the printer driver 221 according to the present exemplary embodiment.

An input correction unit 301 converts image data represented by RGB 8-bit data input from, for example, an application program 220 into 8 bit data of each of cyan (C), magenta (M), and yellow (Y) used in recording. A color compensation unit 302 generates and outputs CMYK (black) data based on the CMY data corrected by the input correction unit 301. An output correction unit 303 determines a value of image data recorded in each pass when the recording is performed by the image recording apparatus 100. In this case, the data recorded in each pass may be corrected based on correction data of a correction table 113. A quantization unit 304 quantizes the CMYK 8-bit image data output from the output correction unit 303 by using, for example, an error diffusion method and outputs CMYK 1-bit data (i.e., recording data) obtained as a result of the quantization.

Figure 3:
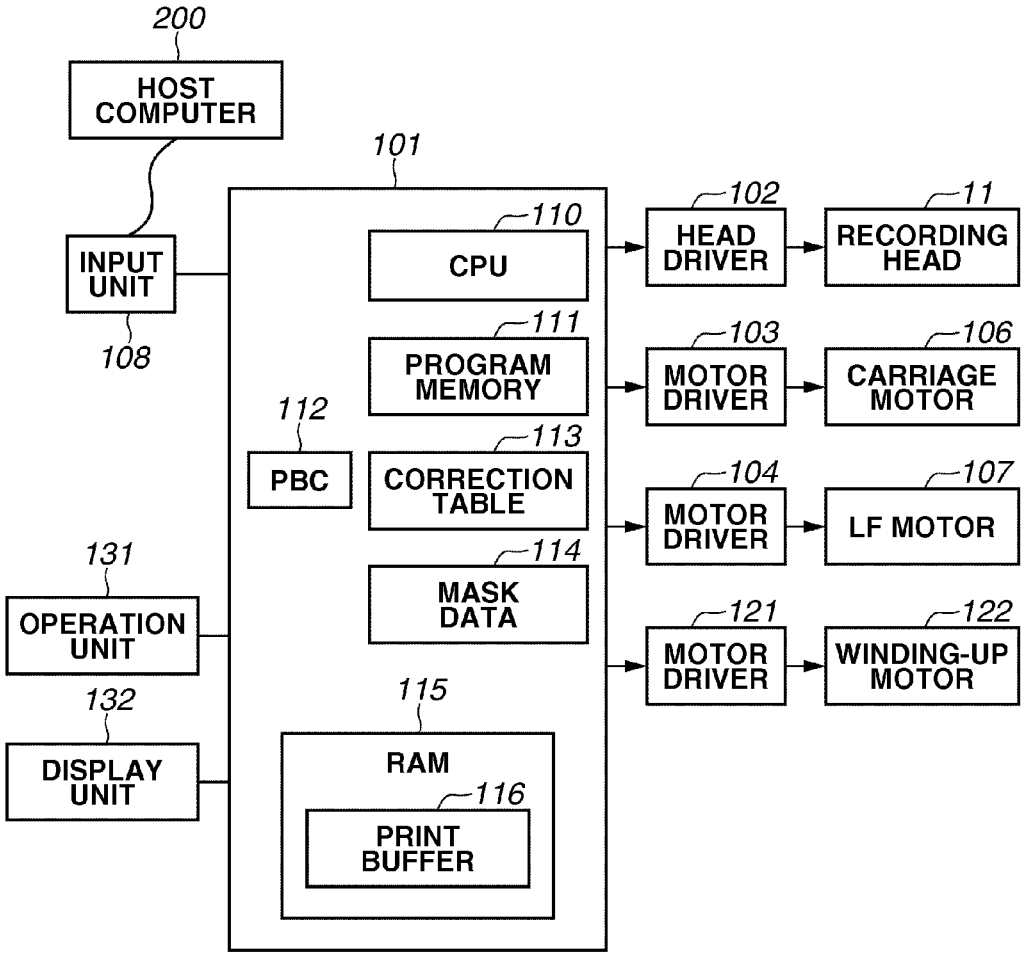
FIG. 3 is a block diagram illustrating a basic configuration of an image recording apparatus.

FIG. 3 is a block diagram illustrating a basic configuration of the image recording apparatus 100 according to an exemplary embodiment of the present invention. It is assumed here that the image recording apparatus 100 has an image processing function illustrated in FIG. 2. However, in a case where the printer driver 221 on a side of the host computer 200 has this function, the image recording apparatus 100 naturally has a simpler configuration without this function.

The image recording apparatus 100 includes a control unit 101 for controlling an operation of the image recording apparatus in its entirety. A head driver 102 drives a recording head 11 based on recording data from the control unit 101. Motor drivers 103 and 104 rotationally drive a corresponding carriage motor 106 and line feed motor (LF motor) 107, respectively. A motor driver 121 rotationally drives a winding-up motor for rotating a roll paper spool. An input unit 108 supplies image data from an external device, e.g., the host computer 200, to the control unit 101. An operation unit 131 includes keys and switches for performing various operations of the image recording apparatus 100, selecting a mode, or inputting various types of data. A display unit 132 displays, for example, a state of the image recording apparatus 100, and a message, a warning, or the like to a user.

A configuration of the control unit 101 is described below. The control unit 101 includes the CPU 110 such as a micro processor, a program memory 111 for storing programs or the like to be executed by the CPU 110, a RAM 115, a print buffer controller (PBC) 112, a correction table 113, and mask data 114. The RAM 115 includes a work area for recording various types of data during operation of the CPU 110 as well as includes a print buffer 116 for storing the recording data. The PBC 112 performs control such that the recording data to be printed (i.e., to be subjected to an image recording) is extracted from the printer buffer 116. The correction table 113 is the one described above with reference to FIG. 2. The mask data 114 is used for determining recording data to be recorded in each scanning of the recording head 11.

Figure 4:
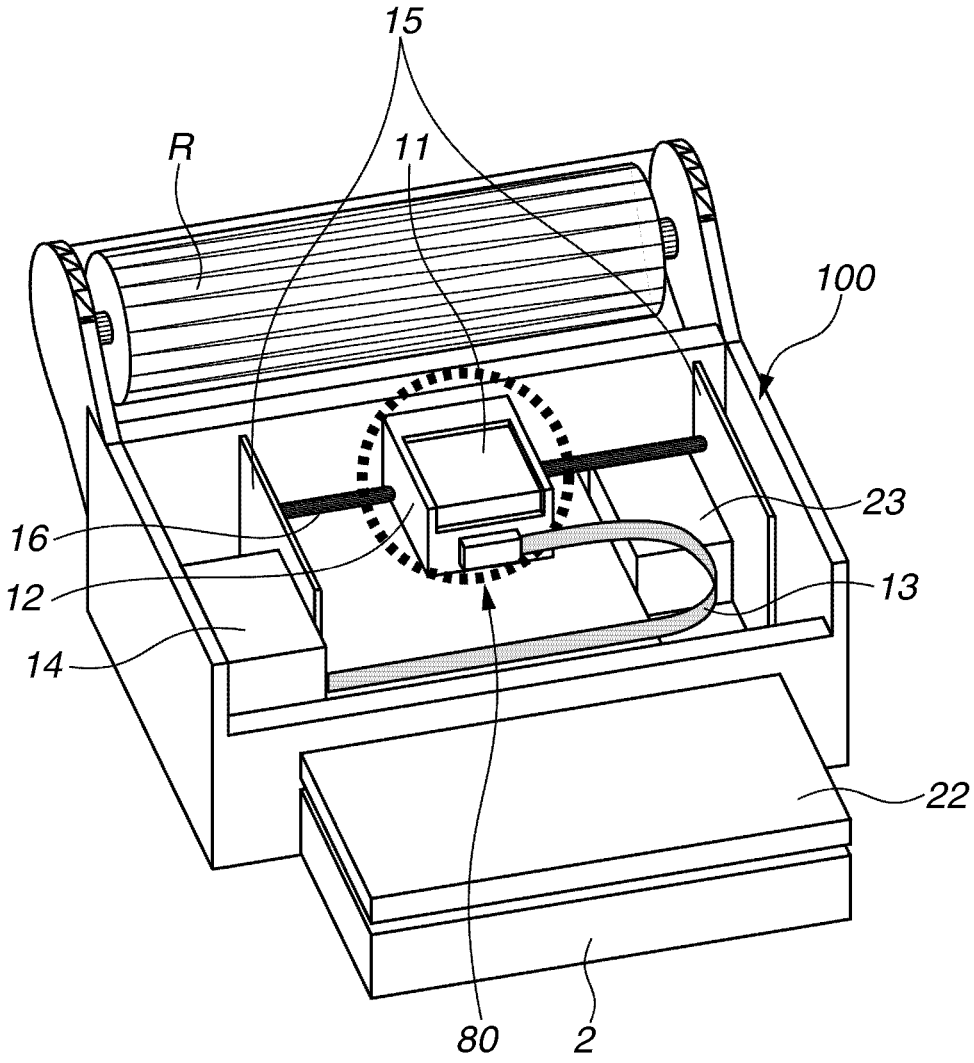
FIG. 4 is a perspective view of the image recording apparatus.

FIG. 4 is a perspective view of the image recording apparatus 100 according to the exemplary embodiment of the present invention. In the present exemplary embodiment, the image recording apparatus is the ink jet recording apparatus as an example. The image recording apparatus (i.e., the apparatus body) 100 includes the recording head 11 and a carriage 12 moving reciprocally with the recording head 11 boarded thereon. The recording head 11 and the carriage 12 form an image forming unit 80. A surface of the recording head 11 facing to the sheet is referred to as a discharging surface. The discharging surface includes a plurality of discharge port arrays formed thereon. Inks of different colors are discharged from each of the discharge port arrays. In each of the discharge port arrays, a plurality of discharge ports is arrayed at a predetermined pitch. The apparatus body 100 includes an ink tank 14 mounted thereon from which each color of inks is supplied via the corresponding ink supply tube 13 of the respective color to each of the discharge port arrays of the recording head 11.

The carriage 12 is slidably guided and supported along a guide shaft 16 and a guide rail (not illustrated) collectively forming a guiding member. The guide shaft 16 and the guide rail are fixed on frames 15 or the like of the apparatus body 100. The frames 15 are arranged in parallel to each other. When the sheet as the recording material is conveyed to the image forming unit 80, the inks are discharged onto the sheet from the recording head 11 while the carriage 12 is reciprocally moved, thereby forming an image on the sheet. A movement of the carriage 12 is controlled by, for example, a carriage motor, a timing belt (i.e., a drive transmission unit), and a linear encoder (all not illustrated). In a recording operation (i.e., in image forming), a speed of the carriage 12 is required to be kept constant. Thus, the speed of the carriage 12 is always monitored using a signal of the linear encoder. When the signal of the linear encoder changes because of some load while the carriage 12 is moved, a current supplied to the carriage motor is adjusted in order to keep the speed of the carriage 12 constant.

Figure 5A:
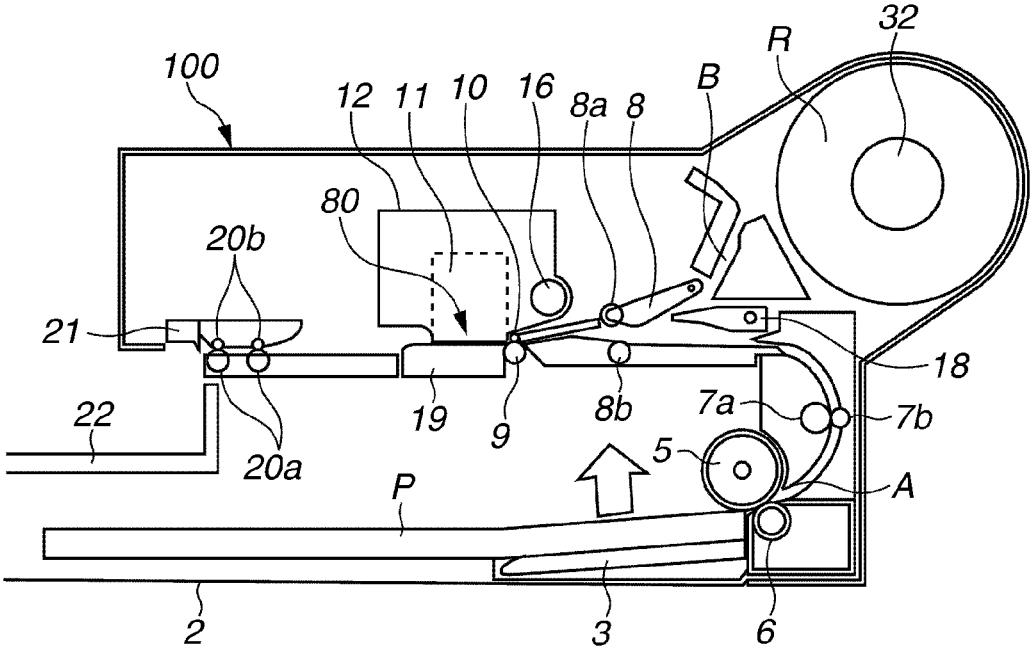
FIGS. 5A and 5B, respectively, are a longitudinal view of the image recording apparatus when a cut paper or a roll paper is conveyed.
Figure 5B:
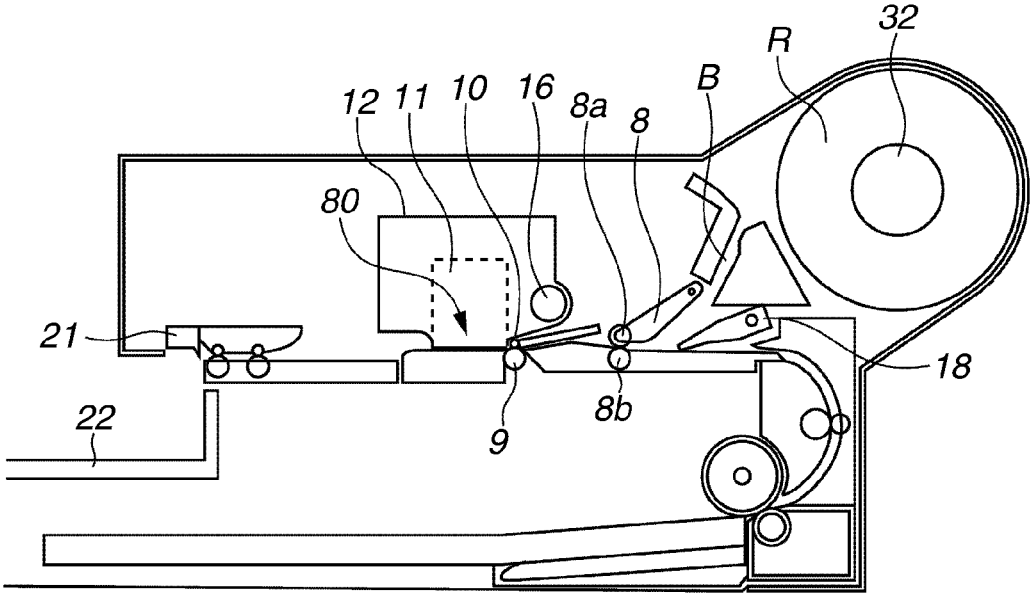
Figure 6:
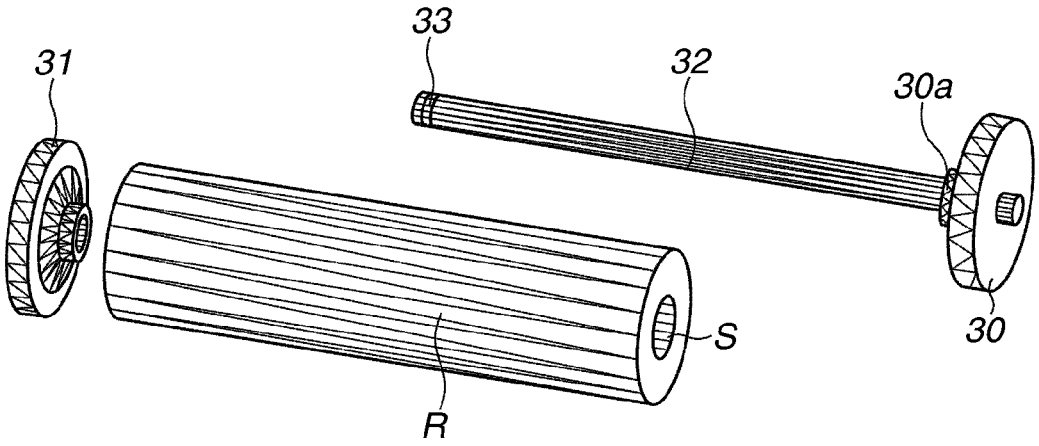
FIG. 6 is an exploded perspective view of a spool for holding the roll paper.

FIG. 5A is a schematic cross sectional view of the image recording apparatus 100 conveying the cut paper. FIG. 5B is a schematic cross sectional view of the image recording apparatus 100 conveying the roll paper. FIG. 6 is an exploded perspective view of the spool for holding the roll paper. A paper feeding and conveyance mechanism of the image recording apparatus 100 according to the present exemplary embodiment is described below with reference to FIGS. 4 through 6. The present exemplary embodiment includes the paper feeding and conveyance mechanism for feeding a cut paper P from a cassette 2 mounted on a bottom section of the apparatus body 100 and a paper feeding and conveyance mechanism for feeding a roll paper R from a spool 32 for the roll paper R mounted at a rear section of the apparatus body 100.

A paper feeding and conveyance mechanism of the cut paper P provided in the bottom section of the apparatus body 100 is described below. At the bottom section of the apparatus body 100, a cassette 2 accommodating cut papers P as the recording materials is detachably mounted. At a sheet send-out unit of the cassette 2, a roller pair composed of a paper feeding roller 5 and a separation roller 6 is arranged in order to separate and send-out the cut paper P piece by piece. The cassette 2 includes a pressing plate 3 for supporting the plurality of stacked cut papers P which presses in an arrow direction in FIG. 5A and an edge regulating plate (not illustrated) for regulating side edges and trailing edges of the plurality of cut papers P. The pressing plate 3 is movably mounted to the cassette 2 and pressed in the arrow direction by a spring (not illustrated). By releasing the regulation force of the pressing plate cum or the like, the cut papers P on the pressing plate 3 are pressed by a paper feeding roller 5. The paper feeding roller 5 is rotated in a counterclockwise direction in FIG. 5 by a motor (not illustrated), so that the uppermost sheet of the cut papers P on the pressing plate 3 is sent out. At the time, the lower cut papers P under the uppermost paper are prevented from being conveyed due to a frictional resistance of the separation roller 6.

The separation roller 6 includes a built-in torque limiter for generating a predetermined rotational load torque. Therefore, the separation roller 6 serves as a nip roller that generates a conveyance force by pinching the cut paper P with an assistance of the paper feeding roller 5 when a torque beyond the rotational load torque is generated. In other words, provided that a frictional force between the paper feeding roller 5 and the cut paper P is F1, a frictional force between the cut papers P is Fp, and a frictional force between the cut paper P and the separation roller 6 (i.e., a tangential force of the rotational load torque) is F3, a relationship between these frictional forces is represented by "F1>F3>Fp". Consequently, only the uppermost cut paper P is sent out from the cassette 2 to a conveyance path A, thereby reaching a nip portion between a conveyance roller 7*a* and a pinch roller 7*b* in the conveyance path A.

The cut paper P is given a conveyance force of the conveyance roller pair 7*a* and 7*b* and is further conveyed to reach a nip portion between the conveyance roller 9 and the pinch roller 10 arranged near an upstream side of the image forming unit 80 as a recording unit. The conveyance roller 9 and the pinch roller 10 form a conveyance unit. At the upstream side of the conveyance roller pair 9 and 10, arranged are a flap 18 for switching to the conveyance path B for the roll paper R and a conveyance roller pair 8*a* and 8*b* for feeding the roll paper R. The flap 18 and the conveyance roller pair 8*a* and 8*b* are at retracted positions as illustrated in FIG. 5A when the cut paper P is fed and conveyed in order to secure the conveyance path A for the cut paper P. A platen 19 is arranged at a position facing to the recording head 11. The cut paper P is conveyed onto the platen 19 while it is pinched by the conveyance roller pair 9 and 10. An image formation (i.e., recording) is started on the recoding surface of the cut paper P. Thus recorded cut paper P is discharged onto a discharge tray 22 through two sets of roller pair, each composed of a conveyance roller 20*a* and a spur 20*b*.

A paper feeding and conveyance mechanism of the roll paper R wound around the spool 32 is described below with reference to FIGS. 4 through 6. FIG. 6 illustrates a roll paper holding unit for holding the roll paper R. The roll paper spool 32 as a roll paper holding unit is inserted into a paper tube S running at a center of winding of the roll paper R. A roll paper holder 30 is fixed to one end of the roll paper spool 32 and a locking unit 30*a* is provided on an inside of the roll paper holder 30. The roll paper spool 32 thus inserted is fixed and held by causing a locking unit 30*a* to be fitted into the paper tube S by a spring force. The other end of the roll paper spool 32 is fixed to the other roll paper holder 31. Accordingly, the roll paper R is set to the roll paper spool 32 in a manner such that it can be wound off. More specifically, the roll paper spool 32 is rotatably mounted on the apparatus body 100. Accordingly, the roll paper R is set such that the roll paper R can be wound off from the roll paper spool 32.

In a conveyance operation of the roll paper R, it is preferable to consider an inertia force caused by a rotation of the roll paper R. Therefore, the roll paper spool 32 is provided with a torque limiter 33 (See FIG. 6) to pose a constant load torque to the rotation (i.e., rotation for the winding off and the winding up) of the roll paper R. With the above described configuration, after the roll paper R starts spinning (i.e., a revolution) according to the rotation of the conveyance roller 9, when the conveyance roller 9 stops, the spinning caused by the inertia force can be quickly killed since the load torque caused by the torque limiter 33 works. In other words, a consideration is made such that a slack due to the inertia force does not occur to the roll paper R while it is conveyed.

The roll paper R set in the apparatus body 100 is sent out through the conveyance path B. A continuous paper sent out from a rolling portion of the roll paper R depresses the flap 18 as well as passes through between the conveyance rollers 8*a* and 8*b* after a nip therebetween is released. Then, the continuous paper is further sent out to a sheet detection unit (not illustrated) arranged in front of the conveyance roller 9. In the present exemplary embodiment, the conveyance roller 8*a* is pivotally supported by the swing arm type flap 8. The sending out of the roll paper R up to now may be performed by an operation of the user or may be automatically performed. When the sheet detection unit detects the roll paper R, the swing arm type flap 8 rotates and conveyance roller 8*a* is press-contacted against the pinch roller 8*b* to nip (pinch) the roll paper R. Subsequently, the conveyance roller 8*a* is rotationally driven to automatically wind off the roll paper R toward the conveyance roller 9. FIG. 5B illustrates a state of the conveyance mechanism at the time. Then, the roll paper R is conveyed onto the platen 19 while it is pinched between the conveyance rollers 9 and 10, thereby starting the image formation (i.e., the recording) on the roll paper R. The recorded roll paper R is conveyed through the 2 sets of roller pairs, each composed of the conveyance roller 20*a* and the spur 20*b*, and discharged onto the discharge tray 22 after the trailing edge of the roll paper R is cut by a cutter 21.

The cut paper P can also pass through the conveyance path B in addition to the roll paper R. In this case, similar to the above described conveyance of the roll paper R, the cut paper P set on an area other than the cassette 2 of the apparatus body 100 is sent out through the conveyance path B. As described above, the conveyance path B is common to the roll paper R and the cut paper P. The cut paper P is conveyed onto the platen 19 in a similar manner as the conveyance of the roll paper R. The cut paper P after being conveyed onto the platen 19 is discharged after an image is formed thereon in the similar manner as the conveyance of the cut paper P in FIG. 5A. The conveyance path B curves more slightly than the conveyance path A, so that the cut paper P that is relatively thicker can also be conveyed. Also, the cut paper P having a length too long to be accommodated in the cassette 2 can also be conveyed.

A recording operation performed in the image forming unit 80 is described below with reference to FIGS. 4 and 5. The image recording apparatus 100 according to the present exemplary embodiment is the ink jet recording apparatus that discharges inks from the recording head 11 onto the sheet to record an image based on image information. The recording head 11 is mounted on the carriage 12. The frames 15 of the apparatus body 100 are provided with the guiding member 16 for guiding the movement of the carriage 12. In other words, the carriage 12 with the recording head 11 mounted thereon is guided and supported along the guiding member 16 such that the carriage 12 can be moved reciprocally in the main scanning direction. The guiding member 16 is formed of a shaft and the carriage 12 is slidably supported by the guiding member 16 via a bearing. The recording head 11 is provided with a discharging surface on which the discharge port arrays, each including a plurality of discharge ports, are formed. In a case where a color image is recorded on the sheet, the plurality of discharge port arrays is used according to the number of colors of inks.

The image recording operation by the recording head 11 is started on the sheet (i.e., the cut paper P or the roll paper R) conveyed onto the platen 19. When the recording of 1 line (i.e., of 1 scanning) by the recording head 11 is completed in synchronization with the movement of the carriage 12, the recording operation is once suspended and the sheet positioned on the platen 19 is conveyed by a predetermined amount by the conveyance roller 9. While the recording head 11 is again moved in the main scanning direction along the guiding member 16, an image of the next 1 line is recorded. Recording of 1 line and a conveyance of the sheet as described above is repetitively executed, thereby recording an image on the entire sheet.

In FIG. 4, a recovery unit 23 that maintains and recovers an ink discharge performance of the recording head 11 is arranged at a position within a range the carriage 12 moves but out of a recording area (normally referred to as the "home position"). During a standby of the recording operation, before and after the recording, or intervals between the recording operations for 1 line, the recording head 11 is moved to a position facing to the recovery unit 23 to cause the recording head 11 to be subjected to a predetermined recovery operation. Examples of the recovery operation include a capping that the discharge ports of the recording head 11 are sealed by using a cap, a suction recovery that inks are sucked from the discharge ports, and a wiping that the discharging surface of the recording head 11 is cleaned. According to the recovery operation, the discharge ports can be prevented from getting clogged and thus an image quality of the recorded image can be secured.

After the image formation by the recording head 11 is performed on the platen 19, the cut paper P is conveyed by the conveyance rollers 20*a* and the spurs 20*b* to be discharged onto the paper discharge tray 22. On the other hand, the roll paper R is conveyed further to the downstream portion by the conveyance roller pair 9 and 19 after a completion of the image formation. The roll paper R is cut by the cutter 21 while it is nipped between the conveyance rollers 20*a* and the spurs 20*b* and is discharged onto the discharge tray 22. After the roll paper R is cut and discharged, the roll paper R connected to the rolling portion is wound up by inversely rotating the conveyance roller pair 9 and 10 and a roll paper spool 32. Subsequently, the leading edge of the roll paper R is rolled back to a predetermined position, thereby causing the roll paper R to be ready for the next image formation.

Figure 7A:
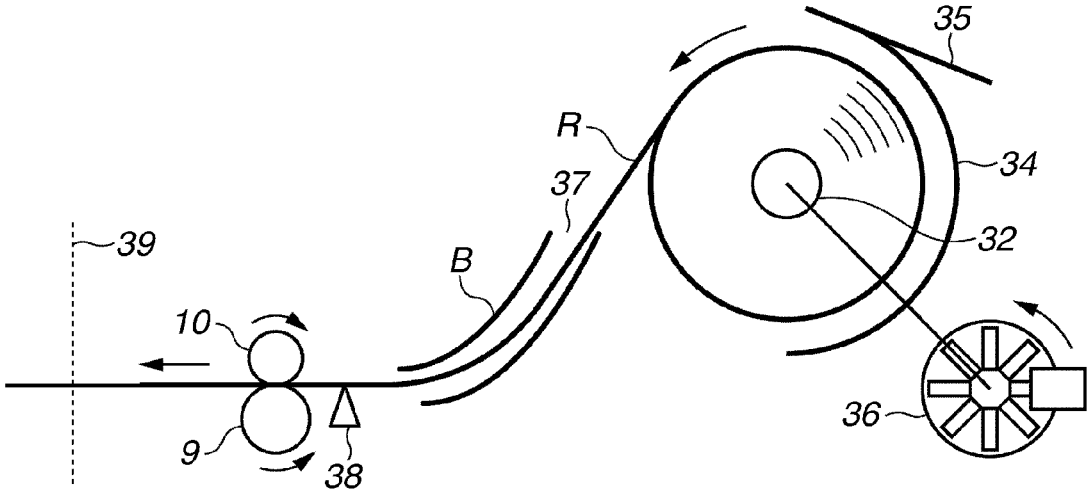
FIGS. 7A and 7B, respectively, are schematic cross sectional views of the image recording apparatus according to an exemplary embodiment at the time of conveying the roll paper or the cut paper.
Figure 7B:
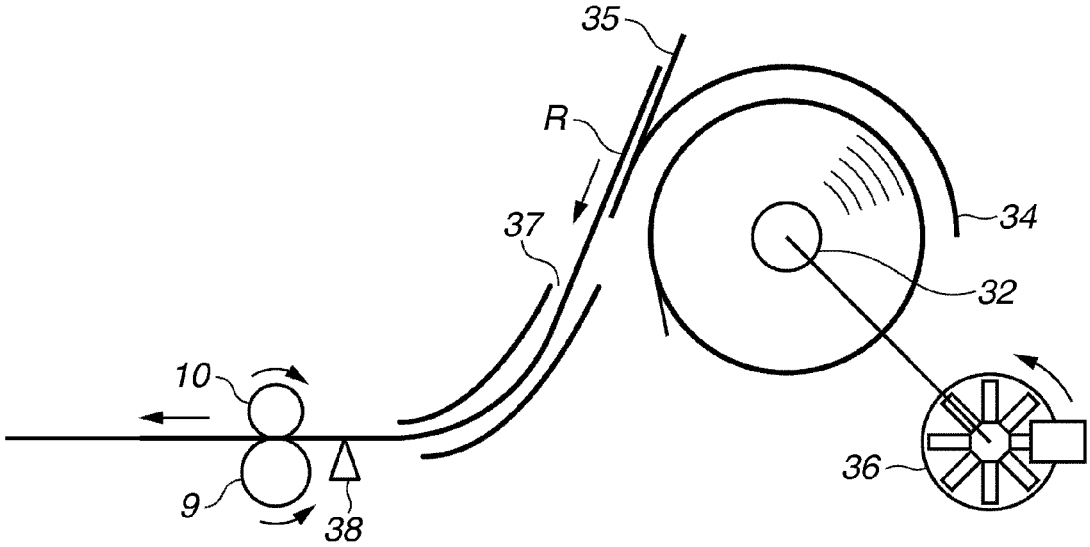

FIGS. 7A and 7B, respectively, schematically illustrate a state in which the sheet (i.e., the cut paper P or the roll paper R) is conveyed through the conveyance path B of the image recording apparatus 100 in FIG. 5B.

FIG. 7A illustrates a state in which the image recording apparatus 100 conveys the roll paper R. At the time, normally, an operation unit 131 as a sheet type selecting unit of the image recording apparatus 100 is used to cause the user to select the roll paper mode. The roll paper mode is a conveyance mode of performing control so as to cause the image recording apparatus 100 to suitably convey the sheet as the roll paper R. In the roll paper mode, the image recording apparatus 100 completes the discharge of the sheet while the sheet is still in the image recording unit 80 after a completion of the recording. The roll paper R is installed in the apparatus body 100 by opening a roll cover 34 and placing both ends of the spool 32 on a spool bearing unit within the roll cover 34 while the spool 32 is inserted into the paper tube S of the roll paper R. The leading edge of the roll paper R is wound off and inserted into the paper feed port 37. The roll paper R is conveyed until the leading edge of the roll paper R contacts the LF roller pair 9 and 10 composed of the pinch roller 10 and the conveyance roller 9 (hereinafter the conveyance roller at this position is specially referred to as the "LF roller") arranged at the upstream side of the image forming unit 80. The paper feed port 37 is an entrance portion of the conveyance path B. When the leading edge of the roll paper R passes a position of a PE sensor 38 as a sheet detection unit arranged in the middle of the conveyance path B, the PE sensor 38 detects the roll paper R and thus the paper feeding operation of the roll paper R is started. When the paper feeding operation is started, the LF motor 107 drives and rotates the LF roller 9. Then, the roll paper R is pinched by the LF roller pair 9 and 10 to be conveyed toward the image forming unit 80 arranged in the downstream thereof.

When the roll paper R is conveyed toward the downstream according to the rotation of the LF roller 9, the roll paper R is wound off from the spool 32 by an amount corresponding to the conveyance amount. Therefore, the rolling portion of the roll paper R rotates in a direction of an arrow illustrated in FIG. 7A. At the time, the spool 32 inserted into the paper tube S of the roll paper R in order to rotationally support the roll paper R in a circumferential direction rotates integrated with the rotation of the roll paper R. Since the rotation of the spool 32 is transmitted to a code wheel of an encoder 36 via a gear array (not illustrated), a change of state generated by the rotation of the code wheel is output by the encoder 36 in the form of an electric signal. In other words, monitoring of the output of the encoder 36 indirectly enables a detection of the state of the rotation of the spool 32 (i.e., a rotation of the roll paper R in a direction the roll paper R is wound off). The encoder 36 is a rotation detection unit.

FIG. 7B illustrates the image recording apparatus 100 conveying the cut paper P. At the time, normally, a cut paper mode is selected through the operation unit as the sheet type selecting unit. The cut paper mode is a conveyance mode that the image recording apparatus 100 controls the sheet to be suitably conveyed as the cut paper P. In the cut paper mode, when the recording is completed, a discharge operation is performed until a trailing edge of the sheet is discharged from the image recording apparatus 100. A leading edge of the cut paper P is inserted into the paper feed port 37 while the cut paper P proceeds along the cut paper guide 35 after closing the roll cover 34. The cut paper P is conveyed until it contacts the LF roller pair 9 and 10 to be set into the apparatus body 100. When the PE sensor 38 detects the leading edge of the cut paper P, a paper feeding operation of the cut paper P is started. Upon starting the paper feeding, a LF motor 107 drives and rotates the LF roller 9. The cut paper P is pinched between the LF roller pair 9 and 10 and subsequently the cut paper P is conveyed toward the image forming unit 80 in the downstream portion.

When the cut paper P is conveyed to the downstream portion by the rotation of the LF roller 9, since the roll paper R is not wound off, the spool 32 does not rotate. Therefore, the code wheel of the encoder 36 also does not rotate, so that the monitoring of the output from the encoder 36 enables a detection of a rotation state of the roll paper R (i.e., a state in which the roll paper R is not rotating). When the cut paper P is installed into the apparatus body 100, since the roll cover 34 is closed, the cut paper P can be prevented from contacting the roll paper R held by the spool 32 to take around the roll paper R or from being rotated because the roll paper R is touched by a hand. Accordingly, an erroneous detection due to an erroneous rotation of the roll paper R can be avoided.

Conveyance processing of the sheet of the present exemplary embodiment is described below in detail with reference to flow charts of FIGS. 8 through 10.

Figure 8:
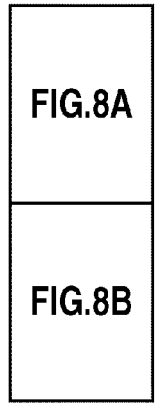
FIG. 8 includes FIG. 8A and FIG. 8B and is a flow chart of processing for feeding the roll paper performed by the image recording apparatus according to an exemplary embodiment of the present invention.
Figure 8A:
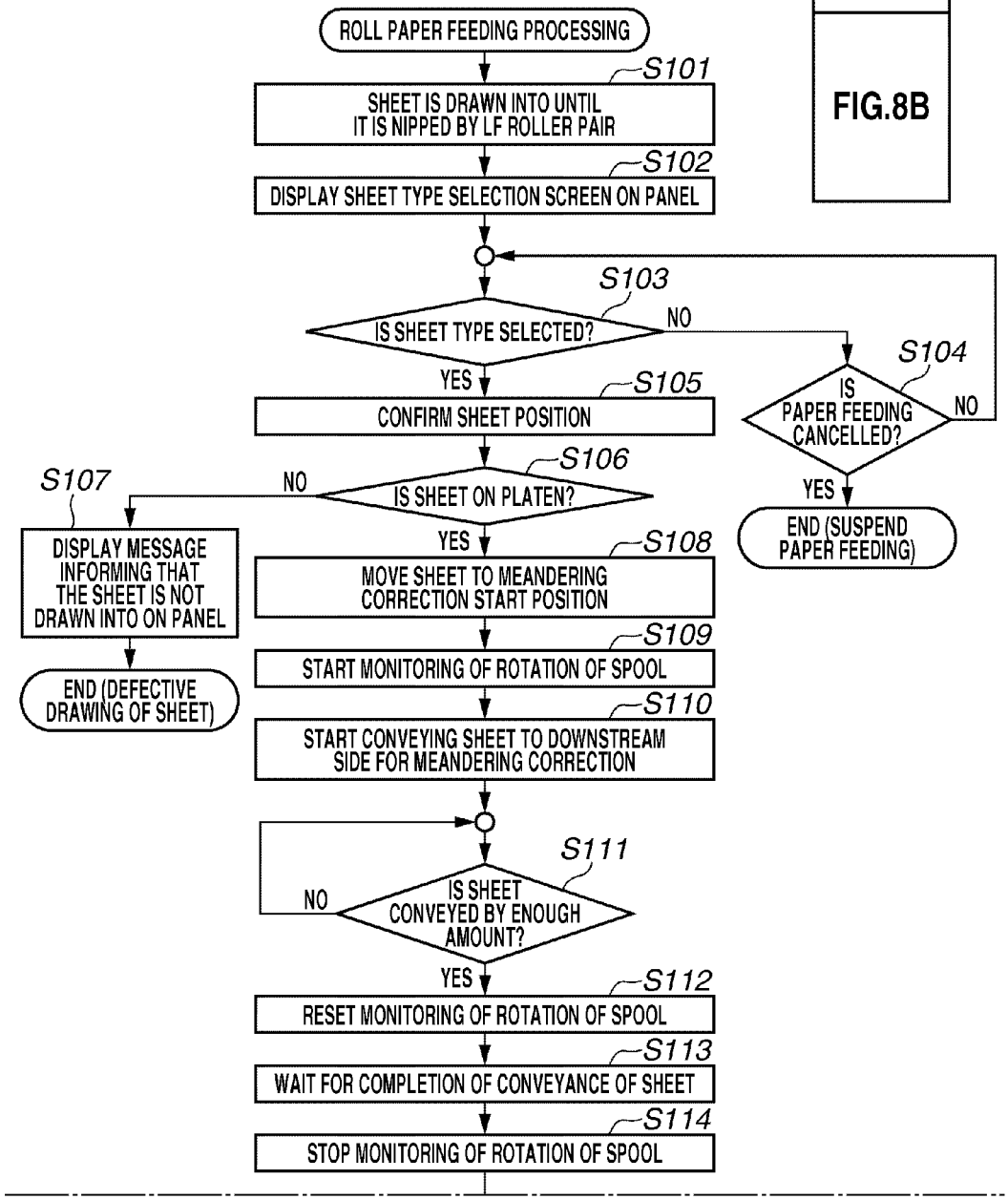
Figure 8B:
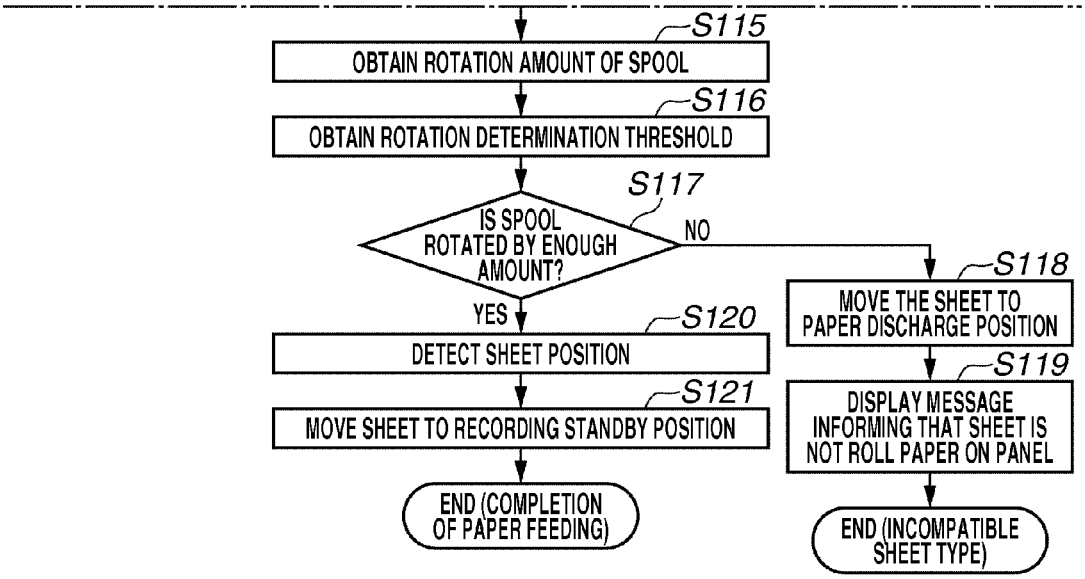

FIG. 8 illustrates paper feeding processing for the roll paper R in the image recording apparatus 100. In the paper feeding processing for the roll paper R, the roll paper R inserted from the paper feed port 37 is conveyed toward the platen 19 positioned at the image forming unit 80 through the conveyance path B, thereby placing the roll paper R in a recordable state.

Figure 9:
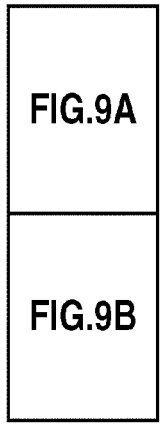
FIG. 9 includes FIG. 9A and FIG. 9B and is a flow chart of processing for feeding the cut paper performed by the image recording apparatus according to an exemplary embodiment of the present invention.
Figure 9A:
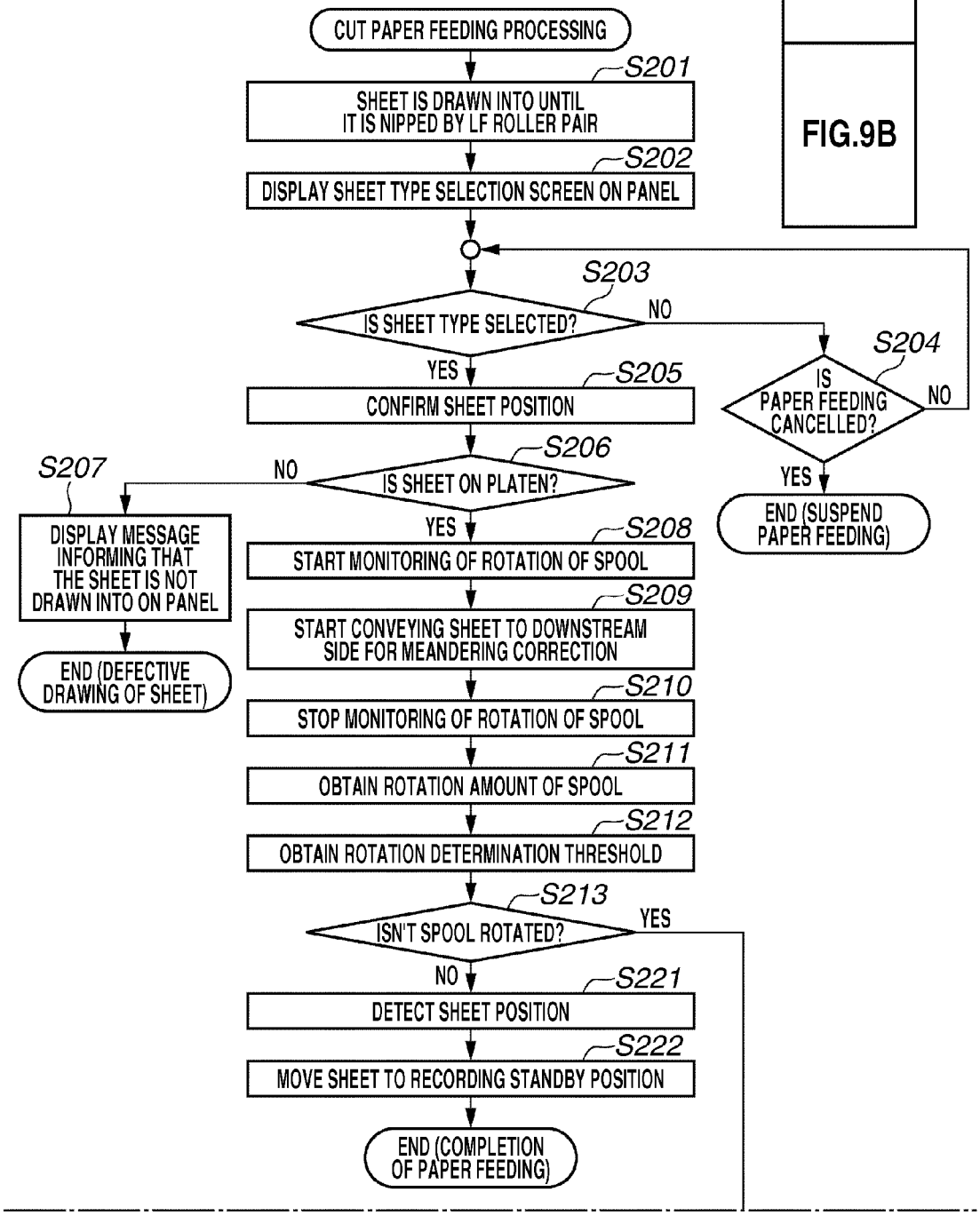
Figure 9B:
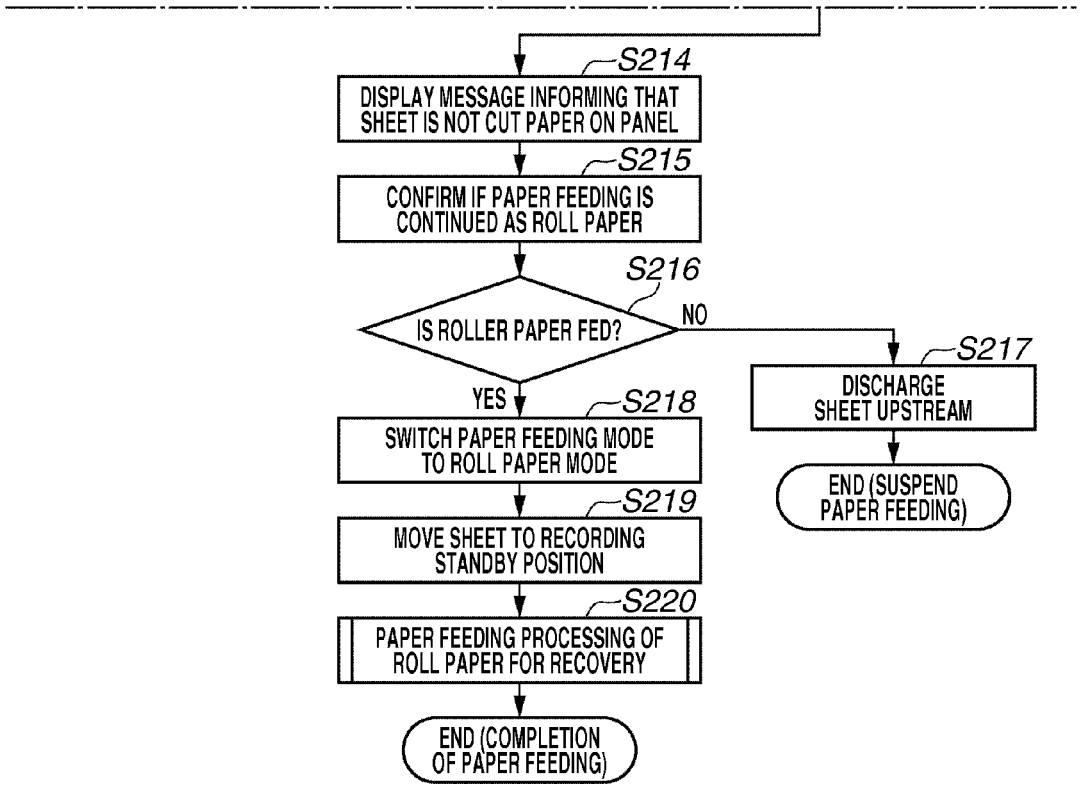

FIG. 9 illustrates paper feeding processing for the cut paper P in the image recording apparatus 100. In the paper feeding processing for the cut paper P, the cut paper P inserted from the paper feed port 37 is conveyed toward the platen 19 positioned at the image forming unit 80 through the conveyance path B, thereby placing the cut paper P in a recordable state.

Figure 10:
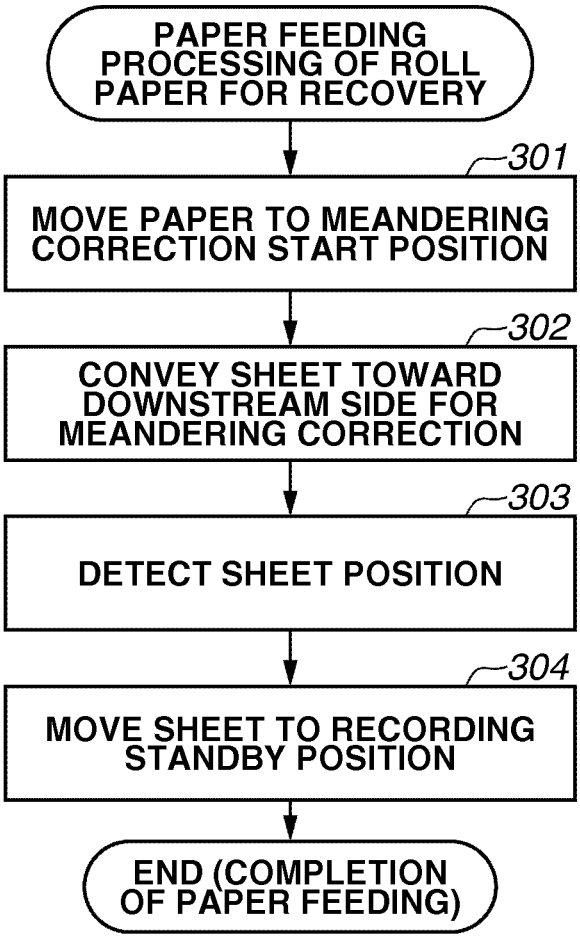
FIG. 10 is a flow chart of processing for feeding a recovery roll paper performed by the image recording apparatus according to an exemplary embodiment of the present invention.

FIG. 10 illustrates recovery roll paper feeding processing in the image recording apparatus 100. In the recovery roll paper feeding processing, when the sheet other than the cut paper P (i.e., the roll paper R) is detected while the paper feeding processing of the cut paper P, the conveyance processing for the roll paper R is restarted.

When the sheet (i.e., the cut paper P or the roll paper R) is sent through the paper feed port 37 while the roll paper mode is selected, if the PE sensor 38 detects the sheet, the paper feeding processing for the roll paper R illustrated in FIG. 8 is started.

With reference to FIG. 8, in step S101, the LF roller 9 is rotated by a predetermined amount such that the sheet detected by the PE sensor 38 is nipped by the LF roller pair 9 and 10. When the sheet is nipped, the following paper feeding operation is automatically performed, so that the user may release his hand from the sheet the user assists to send the sheet. In step S103 (i.e., a sheet type selection), in order to suitably perform the following operations such as the paper feeding and the image recording, the sheet type selecting unit subsequently causes the user to select either one of the roll paper mode and the cut paper mode. More specifically, in step S102, the usable sheet types are listed on a display apparatus of the operation panel. In step S103, the sheet type that matches the sheet to be used in the recording is selected by the user operating a key of the operation unit 131 of the operation panel from the above listed sheet types. In step S104, a predetermined key operation such as an operation of a cancel key enables suspension of the paper feeding operation. At the time, if the user finds the sheet sent into the paper feed port 37 is not the roll paper R (NO in step S104), the above cancelling operation for canceling the paper feeding enables suspension of the paper feeding operation.

In step S105, after the sheet type is selected (YES in step S103), the user confirms a position of the sheet as to whether the sheet passing through the LF roller pair 9 and 10 has been conveyed onto the platen 19. This is because the paper jam may occur in the middle of the conveyance path B or the sheet may not reach the LF roller pair 9 and 10 since an enough amount of the sheet is not sent through the paper feed port 37. In order to confirm the sheet position here, an optical sensor (not illustrated) arranged above the platen 19 of the downstream side of the LF roller pair 9 and 10 can be used.

The optical sensor is positioned above the platen 19 and oriented in a direction of the platen 19. In a case where the sheet is not conveyed onto the platen 19, the optical sensor receives, for example, reflection light (of a small amount) from the platen 19 having a black surface. In a case where the sheet is conveyed onto the platen 19, the optical sensor receives the reflection light (of a large amount) from the sheet having, for example, a white surface. In step S106, the optical sensor can identify presence or absence of the sheet on the platen 19 according to a difference of the received light amount.

In the above described example, it is assumed that the platen 19 has a black surface and the sheet has a while surface, respectively. However, colors of the platen 19 and the sheet are not limited thereto as far as the light amount of the reflection light can be differently detected therefrom. In step S107, in a case where there is not the sheet on the platen 19 (NO in step S106), a message indicative of "a paper jam" is displayed on a display unit 132 of the operation panel and the paper feeding operation is suspended.

In step S108, if the sheet is conveyed onto the platen 19 (YES in step S106), the sheet is moved to a predetermined meandering correction start position 39. In a case where the sheet is conveyed in a meandering manner, the meandering correction is started at the meandering correction start position 39. Starting from the meandering correction start position 39, a correction of the meandering of the sheet and a position detection of the sheet, described below, are performed. Accordingly, a constant paper feeding operation of the sheet can be performed.

Subsequently, in step S109, prior to a start of the below described meandering correction processing, monitoring of a rotation amount of the spool 32 is started. The monitoring of the rotation amount of the spool 32 is performed by monitoring the output of the encoder 36 serving as a rotation amount measurement unit to which the rotation of the spool 32 is transmitted as illustrated in FIGS. 7A and 7B.

In step S110, processing for correcting a sheet position of the roll paper R is performed when the monitoring of the rotation of the spool 32 becomes ready. The processing is referred to as "meandering correction processing". The "meandering" represents a state where a position of the sheet is not fixed because the sheet is shifted or is slacking in a direction orthogonal to a conveyance direction of the sheet (i.e., the main scanning direction) as the sheet is conveyed.

As a meandering correction unit for recovering this state, there is a means for largely drawing out the roll paper R toward the downstream. More specifically, an area around the leading edge of the roll paper R is held and the roll paper R is drawn out, thereby removing the meandering or the slack of the roll paper R in the upstream side of the roll paper R from where it is held.

In the present exemplary embodiment, a drawing-out amount of the roll paper R in the meandering correction processing is set to 300 mm. If the roll paper R is drawn out by 300 mm, even in a case of the roll paper R having a large diameter, e.g., having a diameter of about 100 mm, the roll paper R and the spool 32 rotate almost once (i.e., about one revolution). Therefore, the 300 mm is enough for monitoring the rotation of the spool 32. The drawing-out amount of the roll paper R may be an amount that the roll paper R rotates more than once.

Assuming that now the roll paper R is slacking. If the slack is occurring in the rolling portion of the roll paper R, even if the roll paper R is drawn out in the meandering correction processing, the drawn-out portion of the roll paper R is used in removing the slack of the rolling portion at a time of starting the drawing-out of the rolling paper R. Therefore, in this case, the spool 32 does not rotate. However, the slack of the roll paper R is normally assumed to be less than about 100 mm, so that the slack is removed when the following 200 mm after 100 mm is conveyed, resulting in allowing the spool 32 to rotate. Accordingly, it is preferable that information of the rotation amount of the spool 32 in the first half of the conveyance is discarded to allow only information of the rotation amount of the spool 32 of the last half of the conveyance to be valid.

As described above, immediately after the meandering correction processing, measurement of the rotation amount is performed, so that a possibility of erroneous detection indicating that the sheet is the cut paper P can be reduced even in a case of a small rotation amount of the spool 32. More specifically, in step S111, the conveyance state of the sheet in the meandering correction processing is initially monitored to confirm whether the conveyance of the first half, i.e., the conveyance by 100 mm, is performed. Since the LF roller 9 includes the encoder (not illustrated), it is fed back, as needed, how many time the LF roller 9 rotates, i.e., how much the sheet is conveyed, from driving of the LF motor 107.

In step S112, when the sheet is conveyed by an enough amount and the conveyance of the first half is completed (YES in step S111), the information of the rotation amount acquired as a result of the monitoring of the rotation of the spool 32 is discarded. Accordingly, only the information of the rotation amount of the spool 32 detected after this process remains at the time of ending the monitoring of the rotation of the spool 32 below described.

In step S113, the user waits until the sheet is conveyed in the meandering correction processing by a predetermined distance, i.e., 300 mm here. In step S114, the user then stops monitoring the rotation of the spool 32. In step S115, the rotation amount of the spool 32 is measured based on an output (i.e., the number of pulses) of the encoder 36 that is sampled by monitoring the rotation of the spool 32. Since the code wheel of the encoder 36 is connected to the spool 32 at a predetermined gear ratio, the rotation amount of the spool 32 can be calculated based on the number of pulses of the encoder 36, the resolution of the code wheel, and the gear ratio (i.e., the rotation amount measurement unit).

In step S116, a "rotation determination threshold" preliminarily stored in a memory is obtained from the memory. In step S117, whether the spool 32 and the rolling portion of the roll paper R are rotated while the rotation of the spool 32 is monitored can be determined by comparing the threshold with thus calculated rotation amount of the spool 32. In the present exemplary embodiment, the rotation amount corresponding to a ¼ revolution of the spool 32 is set as the rotation determination threshold. This is because, if the spool 32 rotates by ¼ revolution, it can be assumed that the sheet presently conveyed is the roll paper R. The rotation amount measurement unit detects a rotation direction of the spool 32 and determines whether the sheet is the roll paper R in consideration of whether the rotation direction corresponds to a direction of the rotation of the roll paper R when it is unrolled, which is more preferable since a determination accuracy improves.

In a case where the spool 32 does not satisfactorily rotate in the roll paper mode (NO in step S117), the sheet presently conveyed is assumed as the cut paper P, so that the paper feeding operation is suspended (i.e., conveyance suspension processing). In step S118, in this case, to cause the LF roller pair 9 and 10 to nip an area around the trailing edge of the cut paper P, the LF roller 9 is rotated in a downstream direction until the PE sensor 38 no longer detects the sheet, thereby conveying the cut paper P (i.e., second conveyance resuming processing). As described above, the sheet determined as the cut paper P can be readily taken out from the image recording apparatus 100. Subsequently, in step S119, a message indicating, for example, "sheet is not a roll paper" is displayed on the display unit 132 of the operation panel to notify a user that the sheet does not correspond to the selected sheet type. Further, the message prompts the user to change the mode to the cut paper mode or re-supply the roll paper.

In a case where the spool 32 satisfactorily rotates (YES in step S117), it is assumed that the sheet presently conveyed is the roll paper R. The sheet presently conveyed matches the selected roll paper mode, so that the paper feeding operation in the roll paper mode is continued. In this case, in step S120, the sheet position is detected while the roll paper R drawn out by the above described meandering correction processing is wound up step by step. In the winding-up operation at the time, the spool 32 is rotated by the winding-up motor 122 as the winding up unit, synchronizing with the LF roller, such that no slack is generated in the rolling portion of the roll paper R. Accordingly, the roll paper R is wound up.

Several portions of a set of a leading edge, a left edge, a right edge of the sheet are detected by a sheet edge detection unit (not illustrated) positioned above the platen 19. The sheet edge detection unit is preferably identical to the above described optical sensor. According to the detection result of the sheet edges by the sheet edge detection unit, a sheet position, a skew amount, and a sheet width in the conveyance direction and the main scanning direction can be obtained.

Subsequently, in step S121, the leading edge of the sheet is moved to a predetermined recording standby position to be ready for a start of the recording. In the present exemplary embodiment, it is configured such that the recording area (i.e., the printing area) is not continuously nipped at a position 3 mm downstream of the LF roller pair 9 and 10.

In a state in which the cut paper mode is selected, if the sheet is sent through the paper feed port 37 and the PE sensor 38 detects the sheet, the paper feeding processing for the cut paper P illustrated in FIG. 9 is started.

In step S201, with reference to FIG. 9, the LF roller 9 is rotated by a predetermined amount such that the sheet detected by the PE sensor 38 is nipped by the LF roller pair 9 and 10. When the sheet is nipped, since the following paper feeding operation is automatically performed, the user may remove his hand from the sheet the user is sending.

Subsequently, in order to suitably perform the following paper feeding operation and image recording operation, the display unit as the sheet type selecting unit encourages the user to select the sheet type. More specifically, in step S202, the usable sheet types are listed on the display unit of the operation panel. In step S203, the user selects the sheet type among these sheet types that matches the sheet to be actually fed via the key operation of the operation panel. In step S204, the paper feeding operation can be suspended by operating a predetermined key such as a cancel key. At the time, if the user finds that the sheet sent into the paper feed port 37 is not the cut paper P (NO in step S203), the user can suspend the paper feeding operation through the canceling operation of the paper feeding.

In step S205, when the user selects the sheet type (YES in step S203), the user confirms whether the sheet is conveyed onto the platen 19 after passing through the LF roller pair 9 and 10. This is because the paper jam may occur in the middle of the conveyance path B or the sheet may not reach the LF roller pair 9 and 10 since the sending of the sheet from the paper feed port 37 is not enough. The optical sensor arranged above the platen 19 on the downstream side of the LF roller pair 9 and 10 can be used in confirming the sheet position. The optical sensor is identical to the one that detects whether the roll paper R is on the platen 19 in step S106 illustrated in FIG. 8. In step S206, presence or absence of the sheet in the position of the optical sensor can be identified according to the difference of the light amount received by the optical sensor. In step S207, in a case where the sheet cannot be detected (NO in step S206), a message indicative of "a paper jam" is displayed on the display unit of the operation panel. Then, the paper feeding operation is suspended.

In step S208, if the sheet is conveyed onto the platen 19 (YES in step S206), the monitoring of the rotation of the spool 32 is started prior to the start of the conveyance processing that is performed for the sake of the below described sheet position detection. The monitoring of the rotation of the spool 32 is performed by monitoring the output of the encoder 36 to which the rotation of the spool 32 is transmitted as illustrated in FIG. 7.

In step S209, when the monitoring of the rotation of the spool 32 is ready, the conveyance processing for detecting a sheet position of the cut paper P is performed. The conveyance processing is referred to as the "sheet position detection". In the sheet position detection, positions of the edges of the sheet are detected by the optical sensor. At the time, it is preferable that, by conveying the sheet by a predetermined amount to the downstream side of the platen 19, the detection of the positions of the edges of the sheet around the leading edge is avoided such that the detection is hardly affected by a curled sheet. In the present exemplary embodiment, the conveyance amount of the cut paper P in the sheet position detection is set to 50 mm. This is because, in a case where the sheet presently fed is the roll paper R, even if the roll paper R has a large diameter, e.g., 100 mm, since the roll paper R and the spool 32 rotates about ⅙ revolution, the rotation is enough in monitoring the rotation of the spool 32. As described with reference to FIG. 7B, if the sheet is the cut paper P, the spool 32 does not rotates, so that it is assumed that the sheet is not the cut paper P if the rotation of the spool 32 in the downward direction of the conveyance path is detected.

In step S210, the monitoring of the rotation of the spool 32 is suspended after the completion of the conveyance by the predetermined 50 mm for the sake of the sheet position detection. In step S211, the rotation amount of the spool 32 is obtained based on the output (i.e., the number of pulses) of the encoder 36 that is sampled by the monitoring of the rotation of the spool 32. The code wheel of the encoder 36 is connected to the spool 32 at a predetermined gear ratio, so that the rotation amount of the spool 32 can be calculated based on the number of pulses of the encoder 36, the resolution of the code wheel, and the gear ratio.

In step S212, the preliminarily prepared "rotation determination threshold" is obtained from the memory. In step S213, by comparing the threshold with the rotation amount of the spool 32, whether the spool 32 and the rolling portion of the roll paper R has rotated during the monitoring of the rotation of the spool 32 can be determined. In the present exemplary embodiment, a rotation amount corresponding to a ¼ revolution of the spool 32 is set as the threshold. With this amount of rotation, it can be assumed that the sheet presently conveyed is not the cut paper P.

When the spool 32 rotates in the cut paper mode (NO in step S213), it is assumed that the sheet presently conveyed is not the cut paper P. Therefore, the paper feeding operation of the sheet is suspended. In step S214, a message indicative of "set cut paper" is displayed on the display unit 132 of the operation panel while the conveyance of the sheet is suspended. In steps S215 and S216, a message indicative of, for example, "Is paper to be fed in a roll paper mode? Yes→[OK]/No→[Cancel]" is displayed to require a determination of necessity or unnecessity of the recovery operation (i.e., first conveyance resuming selection).

The recovery operation restarts the conveyance after switching the mode with respect to the sheet presently conveyed from the cut paper mode to the roll paper mode in order to save the roll paper R that is erroneously sent into the paper feed port 37 while the mode remains in the cut paper mode. In the present exemplary embodiment, options by the conveyance resuming selecting unit preferably include 2 options of "the sheet is fed as a roll paper" and "the sheet is not fed as a roll paper". Each of the options can be selected by the user pressing an OK key or a Cancel key of the operation panel.

In step S217, when the user determines that the sheet is not conveyed as the roll paper R (NO in step S216), the sheet remaining on the conveyance path B is discharged out of the conveyance path B. Since the determination is already made that the sheet is not the cut paper P, the sheet is wound up toward the upstream side assuming that the sheet is the roll paper R. Accordingly, since no sheet remains in the conveyance path B, the user may subsequently set sheets, as required.

When the user determines that the sheet is conveyed as the roll paper R (YES in step S216), the user switches the selection mode from the cut paper mode to the roll paper mode. In other words, the sheet remaining in the conveyance path B is conveyed after switching the mode to the roll paper mode (i.e., a first conveyance resumption). More specifically, in step S218, the conveyance mode is switched from the cut paper mode to the roll paper mode in order to treat the sheet in the conveyance path B as the roll paper R. Accordingly, all the operations of the printer, e.g., the recording and the discharging, including the following conveyance operations are optimized with respect to the roll paper R. In this case, in step S219, the roll paper R conveyed half way in the cut paper mode is once moved to an image standby position. Subsequently, in step S220, the recovery roll paper feeding is executed and the paper feeding operation is ended.

In the cut paper mode of FIG. 9, a determination is made that the sheet presently fed is not the cut paper and the user selects to restart the paper feeding in the roll paper mode. In step S220, the recovery roll paper feeding processing illustrated in FIG. 10 is preferably executed.

With reference to FIG. 10, in the recovery roll paper feeding processing in step S220, the roll paper R is conveyed. In step S301, the roll paper R is moved to the meandering correction start position 39. In step S302, the roll paper R is conveyed by a predetermined amount to the downstream portion in order to correct the meandering of the roll paper R. In the present exemplary embodiment, the predetermined amount is set to 300 mm identical to the case of the meandering correction in the paper feeding processing of the roll paper illustrated in FIG. 8. In step S303, a sheet position of the roll paper R having been drawn out by the predetermined amount is detected while it is would up step by step. In step S304, the leading edge of the sheet is positioned at a predetermined recording standby position to be ready for the start of the recording.

The recovery roll paper feeding in the present exemplary embodiment is identical to the processing after step S101 in which the sheet is nipped by the LF roller as illustrated in FIG. 8. However, since the sheet is determined as the roll paper R, the monitoring of the rotation of the spool 32 at the time of meandering correction is not necessary.

A second exemplary embodiment is described below. In the first exemplary embodiment, a determination of the sheet type is made during the paper feeding operation that the sheet is conveyed (i.e., fed) to the recording standby position ready for the start of the recording. However, the present invention is not limited thereto. The processing for determining whether the sheet is the cut paper P or the roll paper R can be performed during the recording onto the sheet or after the recording onto the sheet.

In the operation in the cut paper mode, if a significant slack occurs in the rolling portion of the roll paper R erroneously sent out into the paper feed port 37, since the spool 32 does not normally rotate, a determination of the sheet type may not be properly made. In other words, even if the roll paper R is conveyed, since a portion of the roll paper R having been wound off is used for removing the slack of the rolling portion, the spool 32 does not rotate.

Even in this case, the image recording operation and the paper discharge operation can remove the slack of the rolling portion in a process for further conveying the sheet to the downstream portion, thereby enabling the rolling portion of the roll paper R and the spool 32 to rotate. By making a determination as to the sheet type also in the operations following the paper feeding operation before starting the recording, the roll paper can be detected before the sheet is discharged. Therefore, an unsuitable discharge operation of the sheet can be avoided.

Figure 11:
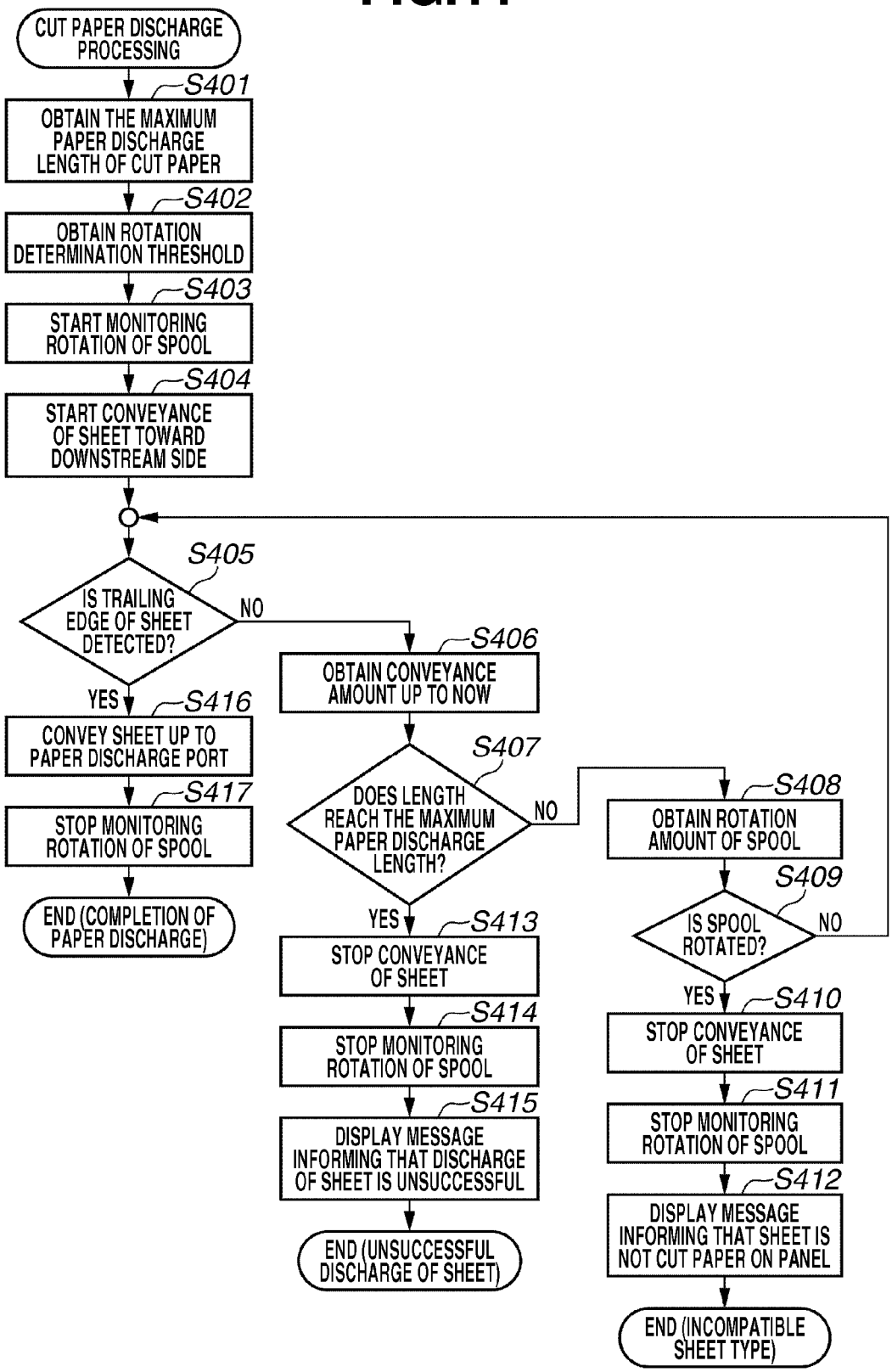
FIG. 11 is a flow chart of processing for discharging the cut paper performed by the image recording apparatus according to an exemplary embodiment of the present invention.

With reference to a flow chart of FIG. 11, the conveyance processing of the sheet according to the present exemplary embodiment is described below in detail. FIG. 11 illustrates paper discharge processing in the cut paper mode in the image recording apparatus 100 (i.e., cut paper discharge processing). In the cut paper discharge processing, the cut paper P on which an image is formed by the image recording operation is discharged onto the paper discharge tray 22. According to an instruction from the host computer 200, the operation proceeds to the paper discharge operation after the image recording operation is performed in the image forming unit 80.

In step S401, with reference to FIG. 11, the maximum paper length of the cut paper P to be discharged is initially obtained from the memory. The "maximum paper length of the paper to be discharged" is a length adding the longest sheet length of the cut paper P that can be treated by the image recording apparatus 100 to a predetermined length of margin. In the present exemplary embodiment, the maximum paper length of the paper to be discharged is set to 1700 mm so that the cut paper P having the sheet length of 1600 mm with the additional predetermined length of the margin can be discharged.

In step S402, the preliminarily prepared "rotation determination threshold" is obtained from the memory. By comparing the rotation determination threshold with the rotation amount of the spool 32, while the rotation of the spool 32 is monitored, whether the spool 32 and the rolling portion of the roll paper R are rotated can be determined. In the present exemplary embodiment, a rotation amount corresponding to a ¼ revolution of the spool 32 is set to be the rotation determination threshold. With the above described rotation amount, it can be assumed that the sheet presently conveyed is not the cut paper P.

In step S403, prior to the start of the conveyance processing toward the below described paper discharge tray 22, the monitoring is started with respect to the rotation of the spool 32. The rotation of the spool 32 is monitored, as described in FIG. 7, by monitoring the output of the encoder 36 (See FIG. 7) as a rotation amount measurement unit to which the rotation of the spool 32 is transmitted.

In step S404, when the monitoring of the rotation of the spool 32 is ready, in order to discharge the sheet onto the paper discharge tray 22, the sheet is started to be conveyed in the downstream direction. In step S405, when the conveyance is started (YES in step S404), monitoring is performed as to whether the trailing edge of the sheet reaches the predetermined position. The trailing edge of the sheet is detected by monitoring a change from a state in which the sheet is detected, to a state in which the sheet is not detected, by the PE sensor 38 provided in the conveyance path B. Until the trailing edge of the sheet is detected, the conveyance of the sheet in the downstream direction is continued. As a consequence, with the cut paper P having any sheet length, the trailing edge of the sheet moves up to a predetermined position immediately upstream from the LF roller pair 9 and 10 on the conveyance path B.

In step S406, in a case where the trailing edge of the sheet is not detected (NO in step S405), a conveyance amount up to now after the PE sensor 38 detects the sheet is obtained. In step S407, whether the conveyance amount reaches the maximum paper length of the paper to be discharged is evaluated. Accordingly, even if the sheet jam occurs in the conveyance path B due to, for example, a defective conveyance, a defective detection of the trailing edge of the sheet and a resulting continuous conveyance of the sheet can be prevented.

In step S408, in a case where the conveyance amount of the sheet does not reach the maximum paper length of the sheet to be discharged (NO in step S407), the rotation amount of the spool 32 up to now obtained by monitoring the rotation of the spool 32 is acquired. In step S409, a determination is made as to whether the spool 32 has been rotated by comparing the rotation amount of the spool 32 with the rotation determination threshold. In a case where the spool 32 does not rotate (NO in step S409), it can be assumed that the sheet presently conveyed is the cut paper P, so that the sheet can be continuously conveyed while the trailing edge of the sheet is monitored.

In step S410, in a case where the spool 32 is rotating (YES in step S409), it is assumed that the sheet presently conveyed is not the cut paper P, so that the conveyance of the sheet is immediately suspended. The is because, a wound-off amount of the unused portion is to be minimized since an unused portion of the roll paper R where no image is formed is also wound off in a case where the sheet is the roll paper R. Then, in step S411, the monitoring of the rotation of the spool 32 is suspended. In step S412, a message indicative of "set cut paper" is displayed on the display unit of the operation panel and the cut paper discharge processing is ended. In this case, the user removes the roll paper R from the conveyance path B after manually cutting the image-formed portion (i.e., the recorded portion) of the roll paper R.

In step S407, in monitoring whether the conveyance amount of the sheet has reached the maximum paper length of the sheet to be discharged, if the conveyance amount has reached the maximum paper length of the sheet to be discharged (YES in step S407), in step S413, the conveyance of the sheet is immediately suspended because of a possible defective conveyance. In this case, in step S414, the monitoring of the rotation of the spool 32 is then also suspended. Then, in step S415, a message indicative of "a paper jam" is displayed on the display unit of the operation panel and the paper disparage processing is ended.

In step S405, in monitoring the trailing edge of the sheet, in a case where the trailing edge of the sheet is detected (YES in step S405), it can be confirmed that the sheet presently conveyed is the cut paper P and the trailing edge of the cut paper P has been conveyed up to a predetermined position immediately upstream of the LF roller pair 9 and 10. Therefore, in step S416, the conveyance of the sheet is further continued. The conveyance amount at the time is a distance adding a distance up to the paper discharge port of the apparatus body 100 to a length of the margin. By conveying the above distance regardless of the sheet length, the trailing edge of the sheet passes through the paper discharge port to discharge the cut paper P to the paper discharge tray 22. In step S417, the monitoring of the rotation of the spool 32 is then suspended and the paper discharge processing is ended.

A third exemplary embodiment is described below. In the first exemplary embodiment, the actual monitoring of the rotation of the spool 32 is performed after the slack of the rolling portion of the roll paper R is removed by the conveyance operation (i.e., the meandering correction operation) executed in the course of the paper feeding operation of the roll paper R. However, the present invention is not limited thereto.

By causing the roll paper R to rotate in a winding-up direction by the roll paper winding-up unit (not illustrated), the slack of the rolling portion can be actively removed. More specifically, a driving amount generated by a motor driving apparatus is transmitted from a side of the image recording apparatus 100 to the spool 32 via the gear arrays having a necessary speed reduction ratio. The roll paper winding-up unit is configured such that the rolling portion of the roll paper R is rotated together with the spool 32. The motor is driven in a predetermined direction such that the rotation force is transmitted in a direction the roll paper R is wound up.

Accordingly, prior to the meandering correction operation, the operation for removing the slack of the rolling portion can be executed. Therefore, since the spool 32 starts rotating when the conveyance starts in the meandering correction operation, the monitoring of the rotation of the spool 32 can be started from the start of the meandering correction operation. Since the determination of the sheet type can be made from the start of the meandering correction operation, the sheet can be determined more accurately.

Not only in the conveyance processing in the roll paper mode but also in the conveyance processing in the cut paper mode (e.g., the cut paper feeding processing and the cut paper discharge processing), an operation for removing the slack may be executed prior to the start of the monitoring of the rotation of the spool 32. Accordingly, the sheet type can be determined by the rotation amount measurement unit in a state in which an affect of the slack of the rolling portion of the roll paper R is removed.

A fourth exemplary embodiment is described below. In the first exemplary embodiment, in a case where a determination is made that the sheet conveyed in the roll paper mode is not the roll paper R, the paper feeding operation is suspended to end the processing. However, the present invention is not limited thereto.

In a case where a determination is made that the sheet is not the roll paper R, i.e., in a case where the paper feeding operation is suspended in a state where the trailing edge of the cut paper P remains in the upstream side of the conveyance path B, the paper feeding can be restarted continuously as it is in the cut paper mode (conveyance resuming means). For example, in a case where the conveyance path B joins halfway with the other conveyance path A, if the trailing edge of the cut paper P is conveyed to the downstream portion from the joining point, a paper jam may occur at the joining point when the sheet is back-fed. Therefore, the sheet cannot be conveyed upstream. Accordingly, before the trailing edge of the sheet reaches the joining point, if a determination is made that the sheet is not the roll paper R and thus the conveyance of the sheet is suspended, the paper feeding can be restarted in the cut paper mode since the sheet can be back-fed.

A fifth exemplary embodiment is described below. In the first exemplary embodiment, in step S117, when a determination is made as to whether the sheet presently conveyed in the roll paper mode is the roll paper R, the preliminarily prepared rotation determination threshold is used. However, the present invention is not limited thereto.

In a case of the roll paper R, the rotation amount of the spool 32 corresponding to a moving amount when the sheet is conveyed in the downstream direction must be detected. Therefore, based on a theoretical rotation amount when there is no slack of the roll paper R and the spool 32 rotates, the rotation amount obtained by multiplying the theoretical rotational amount by a predetermined ratio is set to the rotation determination threshold, thereby enabling more accurate determination. For example, when the rolling portion has a diameter of 100 mm, in a case where the sheet is conveyed by 200 mm to determine the sheet type, 200 mm/(100 mm×π) ≈0.6 revolution is the theoretical rotation amount. Therefore, the rotation amount corresponding to about a half revolution that is the 80% of the theoretical rotation amount is preferably set to the rotation determination threshold. The rotation amount at the time the roll paper R is wound off becomes the minimum value when the diameter of the rolling portion is the maximum value. Therefore, as described above, when calculating the theoretical rotation amount as the rotation determination threshold, it is preferable to use the diameter (i.e., the maximum diameter) at the time when the maximum amount of the roll paper R is wound around the rolling portion. In the above described example, in consideration of the above, the maximum diameter of the rolling portion is set to 100 mm.

Figure 12:
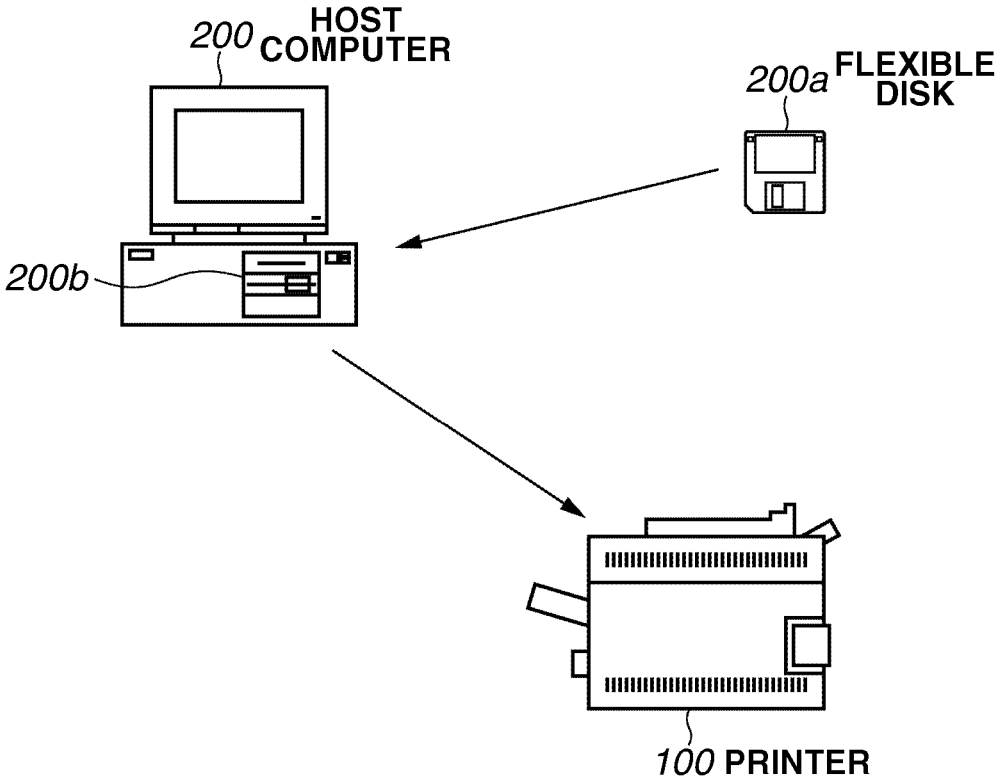
FIG. 12 illustrates a method for supplying a control program and data of the image recording apparatus according to an exemplary embodiment of the present invention.

A sixth exemplary embodiment is described below. FIG. 12 illustrates a case where a flexible disk 200*a* is used as an example of the external storage medium to be connected to the host computer 200. In the above described exemplary embodiment, an example where control programs and data stored in the ROM are loaded into the memory and executed is shown. However, the control programs and the data recorded in the storage medium such as the flexible disk 200*a* may be recorded into a flash ROM provided in the printer 100 from the host computer 200 to which the external storing and reading apparatus 200*b* is connected. Subsequently, the control programs and the data may be loaded into the memory from the flash ROM.

The recording medium for recording the control programs and the data may also be a compact disk read only memory (CD-ROM), an integrated circuit (IC) memory card, or the like, in addition to the flexible disk 200*a*.

Figure 13:
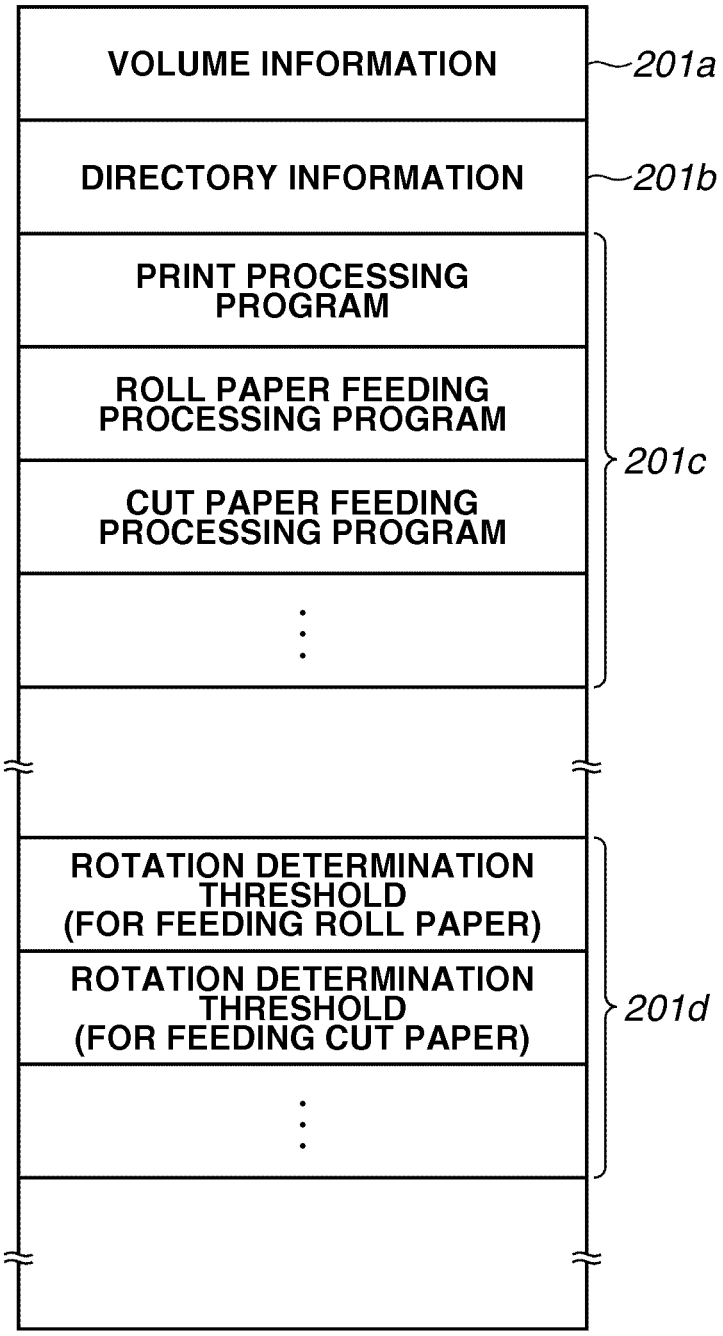
FIG. 13 illustrates a memory map of an external storage medium for supplying the control program and the data of the image recording apparatus according to an exemplary embodiment of the present invention.

The flexible disk drive connected to the host computer 200 reads a memory map illustrated in FIG. 13 of the flexible disk and thus read data is transferred to the printer 100, so that the control programs can be supplied to the printer 100.

FIG. 13 illustrates a memory map in a case where the flexible disk 200*a* is used as an example of the external storage medium to be connected to the host computer 200. The memory map includes a volume information storage area 201*a*, a directory information storage area 201*b*, a control program storage area 201*c*, and a data storage area 201*d* in which the data (e.g., rotation determination threshold) to be used in the control programs is stored. The control program storage area 201*c* stores a predetermined control program. Examples of the predetermined control program include a print processing program, a roll paper feeding processing program for performing the processing of FIG. 8, a cut paper feeding processing program for performing the processing of FIG. 9, and a recovery roll paper feeding program for performing the processing of FIG. 10.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-198997 filed Sep. 6, 2010, which is hereby incorporated by reference herein in its entirety.

What is claimed is:

1. An image recording apparatus for conveying a roll paper as a sheet and a cut paper as a sheet on a common conveyance path to record an image on the sheet, the image recording apparatus comprising:

a sheet type selecting unit configured to allow a user to select, as a sheet type, a mode of either a roll paper mode for conveying the roll paper and a cut paper mode for conveying the cut paper;

a rotation detecting unit configured to detect a rotation of a rolling portion of the roll paper;

a determination unit configured to determine whether the sheet is the roll paper or the cut paper based on the rotation detected by the rotation detecting unit during a conveyance of the sheet;

a conveyance suspension unit configured to suspend the conveyance of the sheet in response to the determination unit determining that the sheet being conveyed is different from the sheet type selected by the sheet type selecting unit; and a restarting unit configured to restart a sheet conveyance suspended by the conveyance suspension unit during the cut paper mode, by switching the mode to the roll paper mode.

2. The image recording apparatus according to claim 1, further comprising:

a recovery roll paper feeding processing unit configured to, in a case where the sheet is determined to be the roll paper, perform a meandering correction to correct meandering of the sheet after the restarting unit restarts the conveyance of the sheet.

3. The image recording apparatus according to claim 1, wherein the restarting unit restarts a sheet conveyance suspended by the conveyance suspension unit during the roll paper mode, by switching the mode to the cut paper mode.

4. The image recording apparatus according to claim 1, further comprising:

a meandering correction unit configured to correct meandering of the sheet while the sheet is conveyed in the roll paper mode, wherein control is performed such that the determination unit is operated immediately after the meandering correction unit corrects meandering of the sheet.

5. The image recording apparatus according to claim 1, wherein the rotation detecting unit and the determination unit are controlled to operate between a time from when the sheet is started to be conveyed to a time when the sheet reaches a recording standby position ready for a start of the recording of the sheet.

6. The image recording apparatus according to claim 5, wherein the rotation detecting unit and the determination unit are controlled to operate while the image is recorded on the sheet or after the image is recorded on the sheet.

7. The image recording apparatus according to claim 1, wherein the rotation amount measurement unit measures a rotation direction in addition to measuring a rotation amount of a rolling portion of the roll paper, and wherein the determination unit determines that the sheet presently conveyed is the roll paper in response to the rotation direction detected by the rotation detecting unit matching a winding-off direction of the roll paper and the rotation.

8. The image recording apparatus according to claim 1, further comprising:

a conveyance restarting selecting unit configured to allow the user to determine whether a conveyance of a sheet is to be restarted after suspension of the conveyance of the sheet by the conveyance suspension unit, wherein the first conveyance restarting unit performs in response to the conveyance restarting selecting unit determining that a conveyance of a sheet is to be restarted.

9. A control method of an image recording apparatus for conveying a roll paper as a sheet and a cut paper as a sheet on a common conveyance path to record an image on the sheet, the control method comprising:

allowing a user to select, as a sheet type, a mode of either a roll paper mode for conveying the roll paper and a cut paper mode for conveying the cut paper;

detecting a rotation of a rolling portion of the roll paper;

determining whether the sheet is the roll paper or the cut paper based on the detection in the detecting;

suspending the conveyance of the sheet in a case where it is determined that the sheet being conveyed is different from the selected sheet type; and restarting a suspended sheet conveyance suspended during the cut paper mode, by switching the mode to the roll paper mode.

10. The control method according to claim 9, further comprising:

performing, in response to the sheet being determined to be the roll paper, a meandering correction to correct meandering of the sheet after the conveyance of the sheet is restarted.

11. The control method according to claim 9, further comprising:

restarting a suspended sheet conveyance during the roll paper mode, by switching the mode to the cut paper mode.

12. The control method according to claim 9, further comprising:

correcting meandering of the sheet while the sheet is conveyed in the roll paper mode, wherein detecting a rotation and determining whether the sheet is the roll paper or the cut paper are executed immediately after meandering of the sheet is corrected.

13. The control method according to claim 9, wherein the detecting a rotation and the determining whether the sheet is the roll paper or the cut paper are controlled to operate between a time from when the sheet is started to be conveyed to a time when the sheet reaches a recording standby position ready for a start of the recording of the sheet.

14. The control method according to claim 13, wherein the detecting a rotation and the determining whether the sheet is the roll paper or the cut paper are controlled to operate while the image is recorded on the sheet or after the image is recorded on the sheet.

15. The control method according to claim 9, wherein detecting a rotation includes detecting a rotation direction in addition to a rotation of a rolling portion of the roll paper, and wherein determining includes determining that the sheet presently conveyed is the roll paper in response to the detected rotation direction matching a winding-off direction of the roll paper and the rotation.

16. The control method according to claim 9, further comprising:

allowing the user to determine whether a conveyance of a sheet is to be restarted after suspension of the conveyance of the sheet, wherein the first conveyance restarting performs in response to it being determined that a conveyance of a sheet is to be restarted.

17. The control method according to claim 16, wherein a roll paper holding unit is rotated to wind up the roll paper in response to it being determined that a conveyance of a sheet is to not be restarted.

18. A computer readable medium storing a program causing an image recording apparatus to perform the method according to claim 9.

19. The computer-readable medium according to claim 18, the method further comprising:

performing, in response to the sheet being determined to be the roll paper, a meandering correction to correct meandering of the sheet after the conveyance of the sheet is restarted.

20. An image recording apparatus that conveys, on a common conveyance path as a sheet, a continuous sheet drawing out from a roll paper or a cut paper, records, as a recording, an image onto the sheet in a recording unit, and discharges the sheet up to a trailing edge in either one of a cut paper mode and a roll paper mode, wherein the cut paper mode is for discharging the sheet after finishing the recording, to an outside of the image recording apparatus, and the roll paper mode is for suspending the discharge of the sheet after finishing the recording while the sheet exists in the recording unit, and wherein one of the cut paper mode and the roll paper mode is selected before starting the conveyance of the sheet, the image recording apparatus comprising:

a rotation detection unit configured to detect a rotation of a rolling portion of the roll paper; and a control unit configured to determine whether the sheet presently conveyed is the roll paper or the cut paper based on a detection of the rotation by the rotation detection unit while the sheet is conveyed and before the recording is started, and suspend the conveyance of the sheet before the recording is started in response to the sheet being incompatible with the selected mode.

21. The image recording apparatus according to claim 20, wherein the control unit switches the selected mode to the roll paper mode in response to the roll paper being conveyed while the selected mode is the cut paper mode.

22. The image recording apparatus according to claim 21, wherein, in response to the roll paper being conveyed while the selected mode is the cut paper mode, the control unit suspends the conveyance of the sheet, and, if an input to select the roll paper mode is received in the image recording apparatus while the conveyance is suspended, the selected mode is switched to the roll paper mode to restart the conveyance of the sheet.

23. The image recording apparatus according to claim 20, further comprising:

a conveyance unit arranged on an upstream side from the recording unit to convey the sheet; and a winding-up unit configured to wind up the sheet by rotating the rolling portion of the roll paper, wherein the conveyance unit conveys the sheet to a length corresponding to about one revolution or a length corresponding to at least one revolution of the rolling portion of the roll paper before starting the recording in response to the selected mode being the roll paper mode, and subsequently conveys the sheet drawn out from the rolling portion by the conveyance unit to the upstream side, while the sheet drawn out from the rolling portion by the winding-up unit is wound up to the rolling portion.

24. The image recording apparatus according to claim 23, wherein, in response to the sheet having a length corresponding to at least one revolution of the rolling portion being conveyed by the conveyance unit, a determination is made that determines whether the sheet is the roll paper or the cut paper.

25. A control method for an image recording apparatus that conveys, on a common conveyance path as a sheet, a continuous sheet drawing out from a roll paper or a cut paper, records, as a recording, an image onto the sheet in a recording unit, and discharges the sheet up to a trailing edge in either one of a cut paper mode and a roll paper mode, wherein the cut paper mode is for discharging the sheet after finishing the recording, to an outside of the image recording apparatus, and the roll paper mode is for suspending the discharge of the sheet after finishing the recording while the sheet exists in the recording unit, and wherein one of the cut paper mode and the roll paper mode is selected before starting the conveyance of the sheet, the control method comprising:

detecting a rotation of a rolling portion of the roll paper;

determining whether the sheet presently conveyed is the roll paper or the cut paper based on a detection of the rotation while the sheet is conveyed and before the recording is started; and suspending the conveyance of the sheet before the recording is started in response to the sheet being incompatible with the selected mode.

26. A computer-readable medium storing a program causing an image recording apparatus to perform the method according to claim 25.

27. The computer-readable medium according to claim 26, the method further comprising:

switching the selected mode to the roll paper mode in response to the roll paper being conveyed while the selected mode is the cut paper mode.

28. A sheet conveying apparatus comprising:

a mode selecting unit configured to select either a roll sheet mode or a cut sheet mode;

a conveying unit configured to convey a sheet; and a detection unit configured to detect a movement of a roll sheet when the conveying unit is conveying the sheet, wherein the conveying unit stops the conveyance of the sheet in a case where the movement of the roll sheet is detected by the detection unit under a condition that the cut sheet mode is selected by the mode selecting unit and in a case where the movement of the roll sheet is not detected by the detection unit under a condition that the roll sheet mode is selected by the mode selecting unit.

29. The sheet conveying unit according to claim 28, further comprising a notification unit configured to perform a notification of a disaccord between the selected sheet mode and the sheet being conveyed in a case where the conveying unit stops the conveyance of the sheet based on a result of the detection by the detection unit.

30. The sheet conveying unit according to claim 28, wherein the detection unit detects the movement of the roll sheet by detecting a rotation of a rolling portion of the roll sheet.

31. An image forming apparatus comprising:

a mode selecting unit configured to select either a roll sheet mode or a cut sheet mode;

a conveying unit configured to convey a sheet;

a detection unit configured to detect a movement of a roll sheet when the conveying unit is conveying the sheet; and a recording unit configured to record an image on a sheet conveyed by the conveying unit, wherein the conveying unit stops the conveyance of the sheet in a case where the movement of the roll sheet is detected by the detection unit under a condition that the cut sheet mode is selected by the mode selecting unit and in a case where the movement of the roll sheet is not detected by the detection unit under a condition that the roll sheet mode is selected by the mode selecting unit.

* * * * *